US007474323B2

(12) United States Patent
Sawada et al.

(10) Patent No.: US 7,474,323 B2
(45) Date of Patent: Jan. 6, 2009

(54) PRINT APPARATUS, RIBBON MOVEMENT CONTROL DEVICE, RIBBON FILM, RIBBON MOVEMENT CONTROL METHOD, AND PROGRAM

(75) Inventors: Koichi Sawada, Kanagawa (JP); Katsuhisa Ono, Tokyo (JP); Satoru Gozu, Kanagawa (JP); Hitoshi Kamoda, Kanagawa (JP)

(73) Assignee: Sony Corporation, Tokyo (JP)

( * ) Notice: Subject to any disclaimer, the term of this patent is extended or adjusted under 35 U.S.C. 154(b) by 188 days.

(21) Appl. No.: 11/495,097

(22) Filed: Jul. 28, 2006

(65) Prior Publication Data

US 2007/0182807 A1 Aug. 9, 2007

(30) Foreign Application Priority Data

Aug. 2, 2005 (JP) ..... 2005-223539
Aug. 2, 2005 (JP) ..... 2005-223540

(51) Int. Cl.
*B41J 2/325* (2006.01)

(52) U.S. Cl. ..... 347/213

(58) Field of Classification Search ..... 347/213, 347/212, 214, 215, 171, 175, 176, 177, 178
See application file for complete search history.

(56) References Cited

U.S. PATENT DOCUMENTS 5,769,549 A 6/1998 Kouzai et al.
5,896,161 A * 4/1999 Kobayashi ..... 347/212
6,812,943 B1 * 11/2004 Day et al. ..... 347/171
2001/0012464 A1 8/2001 Sawano et al.
2007/0115341 A1 * 5/2007 Isaac et al. ..... 347/171

FOREIGN PATENT DOCUMENTS

| | | |
|---|---|---|
| EP | 0 566 058 | 10/1993 |
| EP | 0 655 338 A2 | 5/1995 |
| EP | 1 060 899 A1 | 12/2000 |
| FR | 2 778 143 | 4/1998 |
| JP | 2002-292957 | 10/2002 |
| WO | WO 00/34050 | 12/1999 |

* cited by examiner

*Primary Examiner*—K. Feggins
(74) *Attorney, Agent, or Firm*—Rockey, Depke & Lyons, LLC; Robert J. Depke

(57) ABSTRACT

A print apparatus includes a print unit that records a print pattern with a thermal head and a ribbon film, the ribbon film having a base film on which transfer-material areas and margin areas including cue marks are arranged; a cue-mark detector that detects the cue marks; a ribbon-moving mechanism that moves the ribbon film on which the transfer-material areas and the cue marks are arranged such that L1<L2 is satisfied, where L1 is a distance between the leading edge of each transfer-material area and the corresponding cue mark and L2 is a distance between a transfer position and a cue-mark detection position; and a ribbon movement controller that monitors the cue-mark detection and moves the ribbon film backward by a distance corresponding to the difference between the distances L1 and L2, thereby positioning the ribbon film with respect to a print start position.

18 Claims, 18 Drawing Sheets

PRINT APPARATUS, RIBBON MOVEMENT CONTROL DEVICE, RIBBON FILM, RIBBON MOVEMENT CONTROL METHOD, AND PROGRAM

CROSS REFERENCES TO RELATED APPLICATIONS

The present invention contains subject matter related to Japanese Patent Application JP 2005-223540 filed in the Japanese Patent Office on Aug. 2, 2005 and Japanese Patent Application JP 2005-223539 filed in the Japanese Patent Office on Aug. 2, 2005, the entire contents of which are incorporated herein by reference.

BACKGROUND OF THE INVENTION

1. Field of the Invention

An embodiment of the present invention relates to a print apparatus including a thermal head. Another embodiment of the present invention relates to a ribbon movement control device for positioning a transfer-material area of a ribbon film at a print start position. Another embodiment of the present invention relates to a ribbon movement control method and a program that realize a function of positioning a ribbon film with respect to a print start position by rewinding the ribbon film after detection of a cue mark.

In addition, another embodiment of the present invention relates to a ribbon film suitable for a method of positioning the ribbon film with respect to a print start position by rewinding the ribbon film after detection of a cue mark.

2. Description of the Related Art

A dye-sublimation method, a melting method, and a thermosensitive method are known as printing methods used in thermal printers.

A typical thermal printer includes a line thermal head having a plurality of heating elements (resistance elements) arranged in a print width direction. The amounts of heat generated by the heating elements can be controlled individually in accordance with grayscale levels, and a plurality of dots with different grayscale levels can be recorded on a recording sheet (recording medium). In, for example, the dye-sublimation method, the amounts of heat generated by the heating elements are individually controlled while an ink ribbon is placed between the thermal head and the recording sheet, so that grayscale information is recorded on the recording sheet.

The ink ribbon is usually wound around a feed reel and a take-up reel when the ink ribbon is used. As printing proceeds, the ink ribbon is pulled out from the feed reel and is wound around the take-up reel. The ink ribbon includes a base film on which transfer-material areas formed of dye-containing material (e.g. an ink layer), thermo-compressive material (e.g. a laminate film), etc., are arranged in a longitudinal direction of the ink ribbon.

For example, yellow ink (Y), magenta ink (M), cyan ink (C), and laminate film (L) are arranged in that order.

In addition, a cue mark is formed near the leading edge of each transfer-material area on the ink ribbon. In, for example, an ink ribbon for color printing, the cue mark is used for cueing in an operation of successively transferring different colors of ink on a recording sheet.

The cue mark is, for example, a black, bar-like pattern that extends across the base film and is optically detected by a mark detection sensor positioned downstream of the thermal head.

Normally, a distance L1 between each cue mark and the leading edge of the corresponding transfer-material area is set to be equal to a distance L2 between the mark detection sensor and the thermal head. Therefore, the leading edge of the transfer-material area reaches a position directly under the thermal head (that is, a print start position) at the time when the cue mark is detected by the mark detection sensor.

FIG. 1 shows the structure of a known ink ribbon. The ink ribbon shown in FIG. 1 is can be used for performing superimposed printing using three colors of ink and covering the printed area with a laminate film.

As shown in FIG. 1, each cue mark 1 and a transfer-material area 3 corresponding to the cue mark 1 are separated from each other by a distance L1. In addition, a margin area 5 that does not contribute to printing is disposed between the adjacent transfer-material areas 3. Each cue mark 1 is positioned at the leading edge of the corresponding margin area 5.

The distance L1 is set to be equal to a distance L2 between an attachment position of a mark detection sensor and an attachment position of a thermal head.

Japanese Unexamined Patent Application Publication No. 2002-292957 discloses an example of a known structure.

SUMMARY OF THE INVENTION

In the known ink ribbon structure, the margin areas 5 are provided which each have a length equal to the distance L2 between the attachment position of the mark detection sensor and the attachment position of the thermal head. Since the number of the margin areas 5 is equal to the number of the transfer-material areas formed on the ink ribbon, the total length of the ink ribbon is increased as the number of the transfer-material areas included therein is increased (that is, as the number of sheets that can be printed on is increased).

This also increases the consumption of the base film and waste discarded after printing. Therefore, improvements are demanded in view of both manufacturing cost and environmental load.

In addition, in the known ink ribbon structure, the winding diameter is increased as the length of the base film is increased. This makes it difficult to reduce the size of a ribbon cassette.

The ideal solution is to eliminate the margin areas 5 (that is, to reduce the distance L1 to 0). However, in practice, it is extremely difficult to construct a spatial layout of the thermal printer that allows such an arrangement.

Accordingly, the inventors of the present invention suggest the following ribbon positioning technique.

That is, a ribbon positioning method is suggested which is used in a print apparatus including a print unit that records an arbitrary print pattern on a recording medium by pressing a thermal head against the recording medium with a ribbon film placed between the thermal head and the recording medium, the ribbon film having a base film on which transfer-material areas and margin areas including cue marks for the respective transfer-material areas are alternately arranged in the longitudinal direction of the base film, and a cue-mark detector positioned downstream of the print unit and configured to detect the cue marks. This method includes the following processes:

(a1) a process of monitoring the cue-mark detection performed by the cue-mark detector while the ribbon film is moved forward, the transfer-material areas and the cue marks being arranged on the ribbon film such that L1<L2 is satisfied, where L1, which is 0 or more, is a distance between the leading edge of each transfer-material area and the corresponding cue mark and L2, which is more than 0, is a distance between a transfer position of the thermal head and a cue-mark detection position of the cue-mark detector; and (a2) a process of moving the ribbon film backward toward a feed reel from a position where the cue-mark detection is accomplished by a distance corresponding to the difference between the distances L1 and L2 calculated as L2−L1, thereby positioning the ribbon film with respect to a print start position.

In addition, the inventors of the present invention suggest a ribbon film including a base film on which transfer-material areas and margin areas including cue marks for the respective transfer-material areas are alternately arranged in the longitudinal direction of the base film. In this ribbon film, the transfer-material areas and the cue marks are arranged so as to satisfy the following condition:

(b1) L0<L2 is satisfied, where L0, which is 0 or more, is a distance between the leading edge of each transfer-material area and the leading edge of the corresponding margin area and L2, which is more than 0, is a distance between a transfer position of the thermal head and a cue-mark detection position.

In addition, the inventors of the present invention suggest a ribbon film including a base film on which transfer-material areas and margin areas including cue marks for the respective transfer-material areas are alternately arranged in the longitudinal direction of the base film. In this ribbon film, the transfer-material areas and the cue marks are arranged so as to satisfy the following condition:

(c1) L1<L2 is satisfied, where L1, which is 0 or more, is a distance between the leading edge of each transfer-material area and the corresponding cue mark and L2, which is more than 0, is a distance between a transfer position of the thermal head and a cue-mark detection position.

In addition, another ribbon positioning method is suggested which is used in a print apparatus including a print unit that records an arbitrary print pattern on a recording medium by pressing a thermal head against the recording medium with a ribbon film placed between the thermal head and the recording medium, the ribbon film having a base film on which transfer-material areas and margin areas including cue marks for the respective transfer-material areas are alternately arranged in the longitudinal direction of the base film, and a cue-mark detector positioned downstream of the print unit and configured to detect the cue marks. This method includes the following processes:

(a1) a process of monitoring passage of a cue mark through a cue-mark detection position of the cue-mark detector while a print operation using the transfer-material area corresponding to the cue mark is being performed, the transfer-material areas and the cue marks being arranged on the ribbon film such that L1<L2 is satisfied, where L1, which is 0 or more, is a distance between the leading edge of each transfer-material area and the corresponding cue mark and L2, which is more than 0, is a distance between a transfer position of the thermal head and the cue-mark detection position;

(a2) a process of determining a movement amount by which the ribbon film is moved in a period between the detection of the cue mark and the end of the print operation; and (a3) a process of subtracting the determined movement amount from the sum of a length of an unprocessed portion of the transfer-material area determined on the basis of the format of the ink ribbon at the time when the cue mark is detected and the length of each margin area and moving the ribbon film forward by a distance corresponding to the result of subtraction, thereby positioning the leading edge of the next transfer-material area at a print start position.

In the ribbon positioning technique according to an embodiment of the present invention, the leading edge of each transfer-material area can be positioned at a position directly under the thermal head (print start position) by moving the ink ribbon backward toward a feed reel by a distance corresponding to L2−L1 from the cue-mark detection position (from the position where the cue-mark detection is accomplished).

Accordingly, the limit to the attachment position of the cue-mark detector and the attachment position of the thermal head in the thermal printer can be reduced.

In addition, when the distance L0 between the leading edge of each transfer-material area and the leading edge of the corresponding margin area is smaller than the distance L2 between the transfer position of the thermal head and the cue-mark detection position, the total length of the ink film can be reduced compared to that of the known ink film without reducing the number of sheets that can be printed on.

In addition, when the distance L1 between the leading edge of each transfer-material area and the corresponding cue mark is smaller than the distance L2 between the transfer position of the thermal head and the cue-mark detection position, the distance L0 between the leading edge of each transfer-material area and the leading edge of the corresponding margin area can be set smaller than the distance L2. Therefore, the total length of the ink film can be reduced compared to that of the known ink film without reducing the number of sheets that can be printed on.

In the ribbon film positioning technique according to an embodiment of the present invention, the leading edge of a transfer-material area is positioned by the following method. That is, first, the length of the unprocessed portion of the transfer-material area that is being subjected to print operation is determined on the basis of the ink-ribbon format at the time when the cue mark corresponding to the transfer-material area is detected. Then, the sum of the length of the unprocessed portion and the length of each margin area is calculated. Then, the amount by which the ink ribbon is moved during a period between the detection of the cue mark and the end of the print operation is subtracted from the above obtained sum. Then, the ink ribbon is moved forward by an amount corresponding to the result of subtraction.

Accordingly, during the print operation for the transfer-material area, preparation for the calculation of the feed amount for positioning the next transfer-material area can be performed.

In addition, it is not necessary that the length L2 between the transfer position of the thermal head and the cue-mark detection position be equal to the length L1 between the leading edge of each transfer-material area and the corresponding cue mark. Therefore, the limit to the attachment position of the cue-mark detector and the attachment position of the thermal head in the thermal printer can be reduced.

In addition, when the distance L1 between the leading edge of each transfer-material area and the corresponding cue mark is smaller than the distance L2 between the transfer position of the thermal head and the cue-mark detection position, the distance L0 between the leading edge of each transfer-material area and the leading edge of the corresponding margin area can be set smaller than the distance L2. Therefore, the total length of the ink film can be reduced compared to that of the known ink film without reducing the number of sheets that can be printed on.

DESCRIPTION OF THE PREFERRED EMBODIMENTS

Embodiments of the present invention will be described below. With regard to components that are not particularly illustrated or described in this specification, commonly or publicly known technology is applied.

The embodiments described below are merely exemplifications, and the present invention is not limited thereto.

First Embodiment

A. Structure of Ink Ribbon

Figure 1:
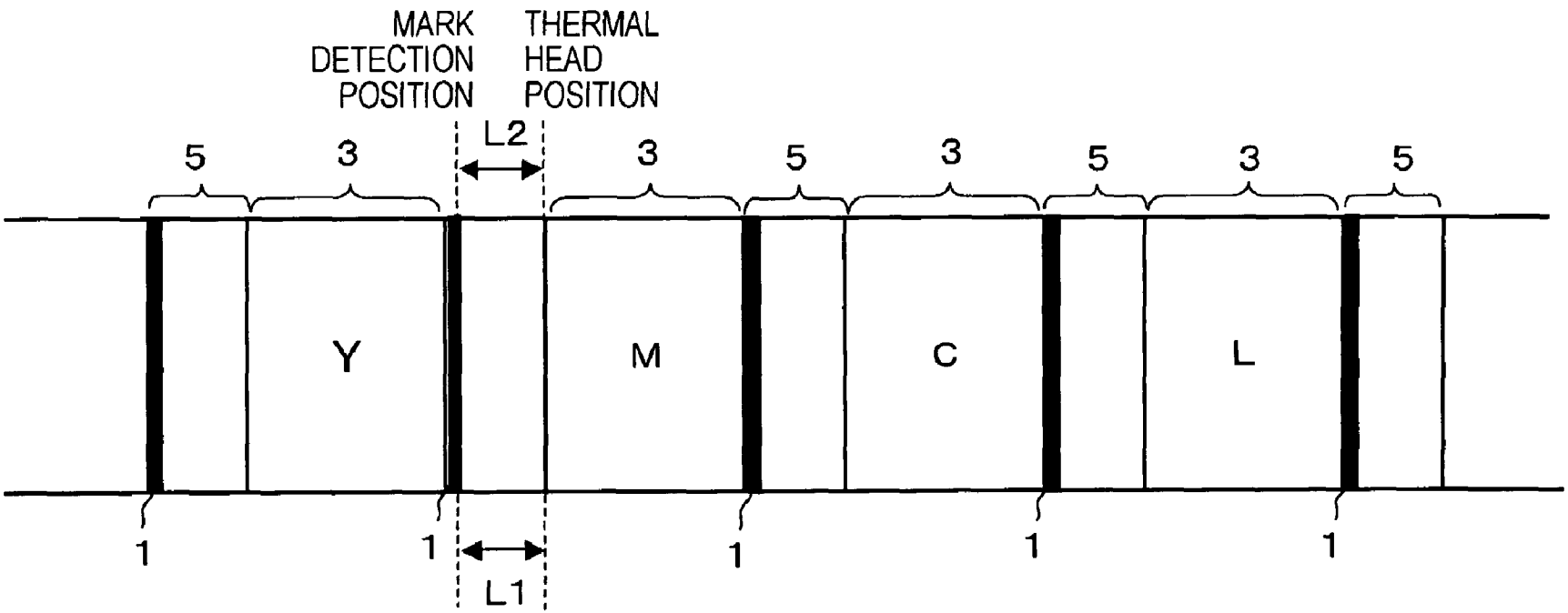
FIG. 1 is a diagram illustrating a known ink ribbon.
Figure 2:
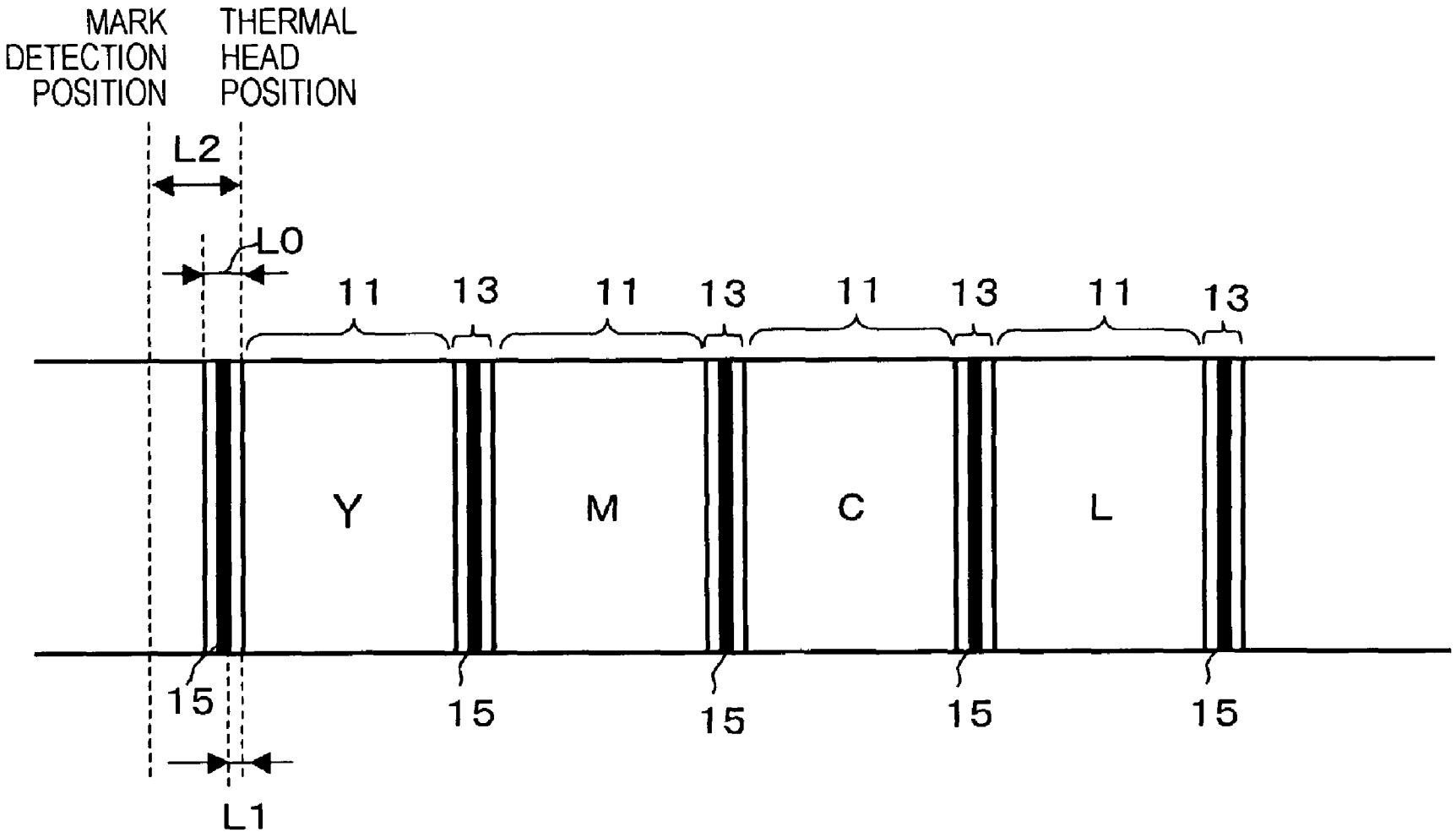
FIG. 2 is a diagram illustrating the structure of a suggested ink ribbon.

FIG. 2 shows an example of an ink ribbon used in the present embodiment. The ink ribbon shown in FIG. 2 is used for performing three-color printing and covering the printed area with a laminate film.

The ink ribbon has transfer-material areas 11 and margin areas 13 that are alternately arranged on a base film in a longitudinal direction thereof. In the present embodiment, a length L0 of each margin area 13 is shorter than a distance L2 between a transfer position of a thermal head and a cue-mark detection position. In other words, the margin areas 13 are arranged such that L0<L2 is satisfied.

The transfer-material areas 11 are formed by applying solid ink (dye-containing material) of yellow (Y), magenta (M), and cyan (C) and a laminate film (thermo-compressive material) to the base film.

The margin areas 13 are connecting areas disposed between the adjacent transfer-material areas 11. Each margin area 13 has a cue mark 15 used for positioning the corresponding transfer-material area 11. In the present embodiment, the cue mark 15 is disposed at substantially the center of each margin area 13 in the longitudinal direction of the base film in the width direction thereof.

Therefore, a distance L1 (>0) between each cue mark 15 and the leading edge of the corresponding transfer-material area 11 is shorter than the distance L2 between the transfer position of the thermal head and the cue-mark detection position. In other words, L1<L2 is satisfied.

The cue marks 15 have an optical characteristic different from that of the margin areas 13, so that the cue marks 15 can be optically detected. For example, when the base film is composed of a transparent material in the margin areas 13, the cue marks 15 are formed as nontransparent patterns. In the present embodiment, the cue marks 15 are formed as black bars that extend across the base film.

As described above, the length L0 of each margin area 13 is shorter than the distance L2 between the transfer position of the thermal head and the cue-mark detection position.

Therefore, compared to the known ink ribbon, the total length of the ink ribbon shown in FIG. 2 can be largely reduced without reducing the number of sheets that can be printed on.

Figure 3:
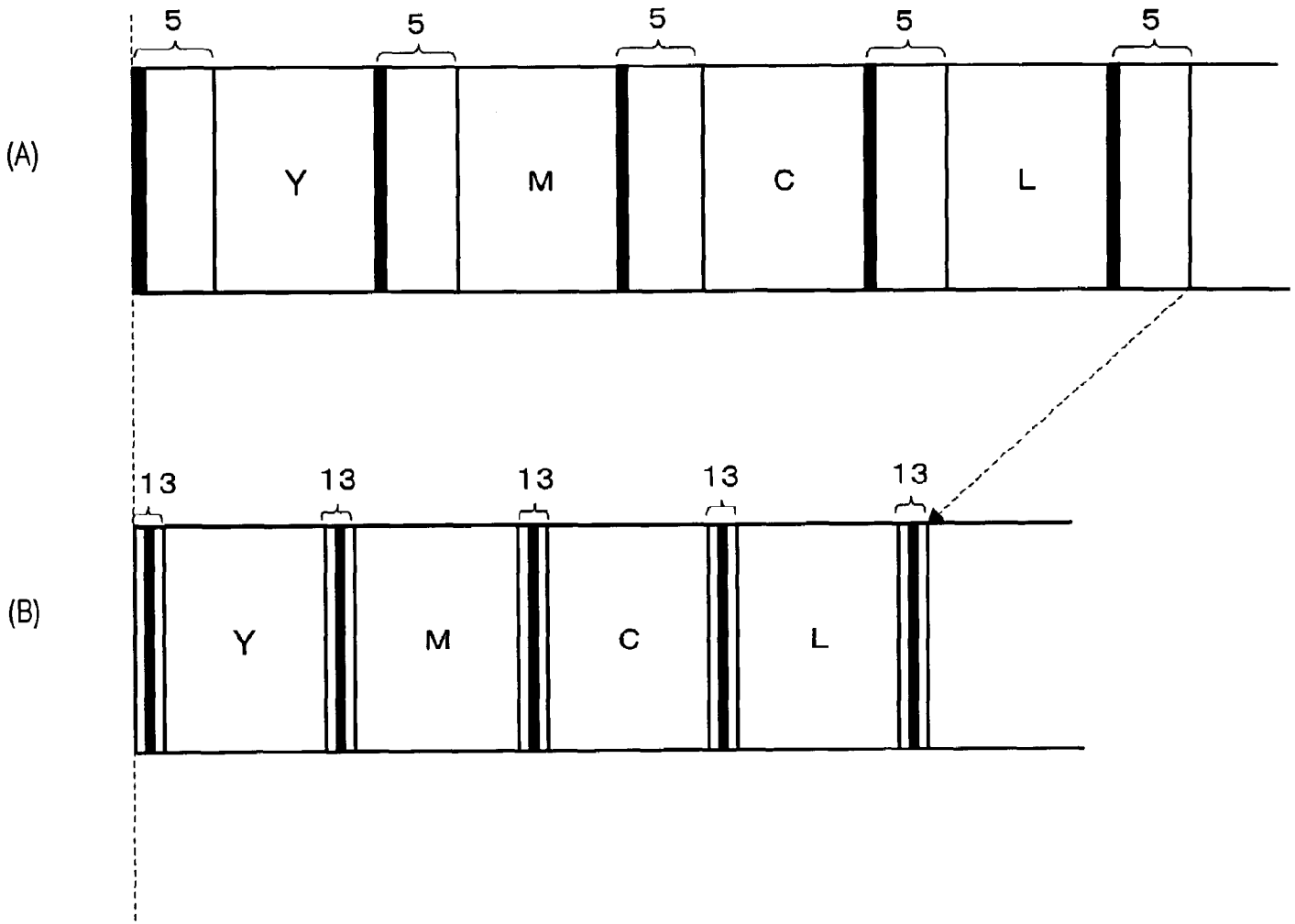
FIG. 3 is a diagram illustrating the manner in which space is efficiently utilized in the suggested ink ribbon.

FIG. 3 is a diagram illustrating the difference between the structure of the known ink ribbon and the structure of the ink ribbon according to the present embodiment. In FIG. 3, (A) shows the known ink ribbon and (B) shows the ink ribbon according to the present embodiment.

As is clear from FIG. 3, the length of each margin area is the main difference between the two structures, and this difference provides a significant reduction in length even in a portion including only four transfer-material areas.

However, when the ink ribbon having the structure shown in FIG. 2 is simply attached to a known thermal printer, correct print results may not be obtained.

In the following description, a thermal printer having a control function for correctly moving the ink ribbon having the structure shown in FIG. 2 will be explained.

B. Thermal Printer

B-1. System Structure

Figure 4:
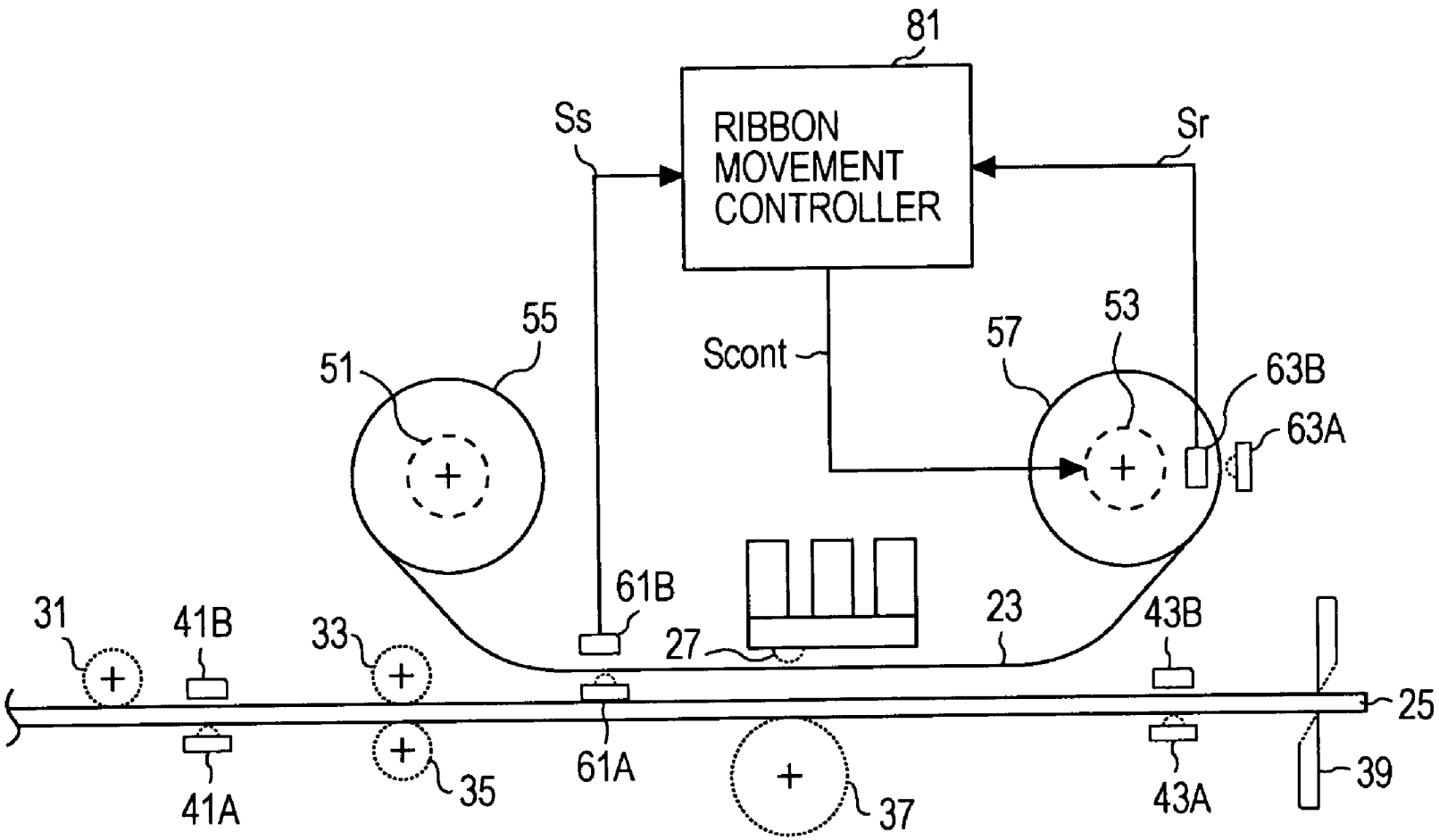
FIG. 4 is a diagram illustrating an example of a system structure of a thermal printer.

FIG. 4 shows an example of a system structure of a dye-sublimation thermal printer. The thermal printer uses an ink ribbon 23 to which sublimable solid ink is applied in the transfer-material areas thereof, and is capable of performing three-color printing using yellow (Y), magenta (M), and cyan (C).

FIG. 4 illustrates only the main portion of the structure for moving the ink ribbon 23 and a recording sheet 25. Therefore, the actual thermal printer includes known control devices and drive devices in addition to the devices shown in FIG. 4.

In the thermal printer shown in FIG. 4, the recording sheet 25 is wound in a roll shape. The recording sheet 25 is held in a container (not shown) and is pulled out from the container into a print section, where a thermal head 27 is placed, along a moving path.

The thermal printer includes devices located on the moving path of the recording sheet 25 and devices located on a moving path of the ink ribbon 23.

The devices located on the moving path of the recording sheet 25 include a guide roller 31, a pinch roller 33, a capstan 35, and a platen roller 37.

The guide roller 31 guides the recording sheet 25 pulled out from the container (not shown).

The pinch roller 33 and the capstan 35 form a drive mechanism for moving the recording sheet 25 in forward and reverse directions at a constant speed while holding the recording sheet 25 between the pinch roller 33 and the capstan 35.

The platen roller 37 ejects the recording sheet 25 on which a print pattern is printed.

A cutter 39 is positioned near an ejection hole through which the recording sheet 25 is ejected, and the recording sheet 25 is cut at a predetermined position by the cutter 39 after the print pattern is printed thereon.

Various kinds of sensors are arranged along the moving path of the recording sheet 25.

For example, a sensor for detecting the presence/absence of the recording sheet 25 being fed is disposed between the guide roller 31 and the pinch roller 33 (capstan 35). This sensor is, for example, a transmissive sensor including a light-emitting diode 41A and a phototransistor 41B.

Similarly, a sensor for detecting the presence/absence of the recording sheet 25 being ejected is disposed between the platen roller 37 and the cutter 39. This sensor is, for example, a transmissive sensor including a light-emitting diode 43A and a phototransistor 43B.

The thermal printer also includes an ink-ribbon-moving mechanism including a take-up motor 51 and a rewind motor 53.

The take-up motor 51 is used for rotating a take-up reel 55 to pull out the ink ribbon 23 from a feed reel 57.

The rewind motor 53 is used for rotating the feed reel 57 to pull out the ink ribbon 23 from the take-up reel 55.

The moving path of the ink ribbon 23 is also provided with various kinds of sensors.

For example, a mark detection sensor for detecting a cue mark is disposed between the thermal head 27 and the take-up reel 55. This sensor is, for example, a transmissive sensor including a light-emitting diode 61A and a phototransistor 61B. This sensor is disposed at a position (mark detection position) shifted by the distance L2 from the attachment position of the thermal head 27 (transfer position) in the moving direction of the ink ribbon 23.

In addition, a sensor for detecting a rotation amount of the feed reel 57, which indirectly represents a rewind amount of the ink ribbon 23, is disposed on a rotating shaft of the feed reel 57. This sensor is, for example, a transmissive sensor including a light-emitting diode 63A and a phototransistor 63B.

Figure 5A:
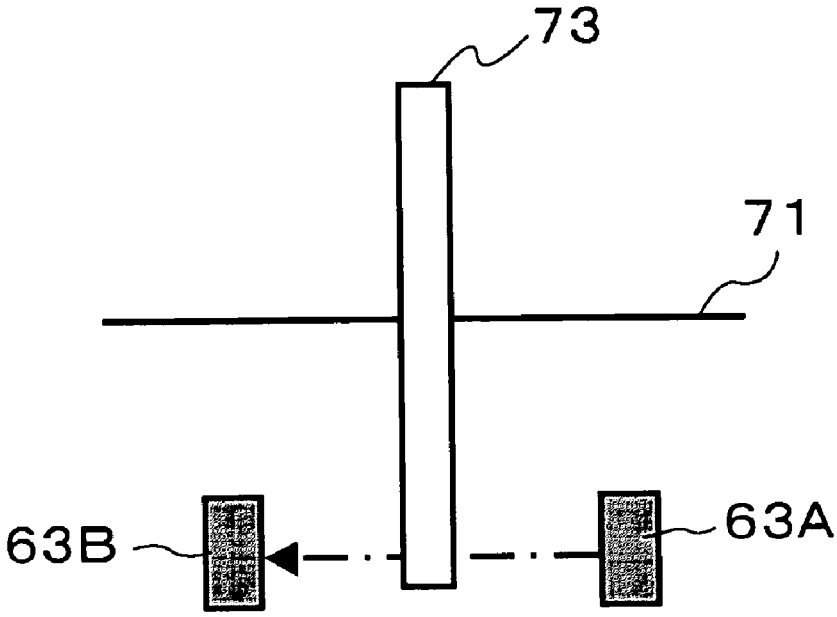
FIGS. 5A and 5B are diagrams illustrating an example of the structure of a sensor for detecting a rewind amount of the ink ribbon.

As shown in FIG. 5A, the light-emitting diode 63A and the phototransistor 63B are arranged so as to face each other across a disc 73 attached to the rotating shaft 71 of the feed reel 57.

Figure 5B:
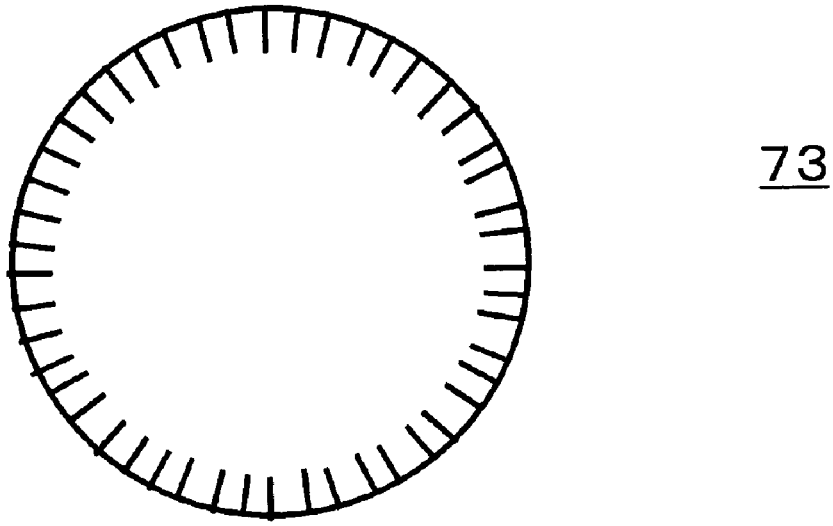

As shown in FIG. 5B, the disc 73, which functions as a pulse generator (encoder), has a plurality of slits arranged along the circumference thereof. For example, 90 slits are formed. In this case, an On or Off signal is detected 180 times while the rotating shaft 71 of the feed reel 57 (disc 73) rotates one turn.

The thermal printer also includes a ribbon movement controller 81 for controlling the movement of the ink ribbon 23. The ribbon movement controller 81 controls both the take-up motor 51 and the rewind motor 53. FIG. 4 shows the manner in which the ink ribbon 23 is rewound after cue-mark detection.

Figure 6:
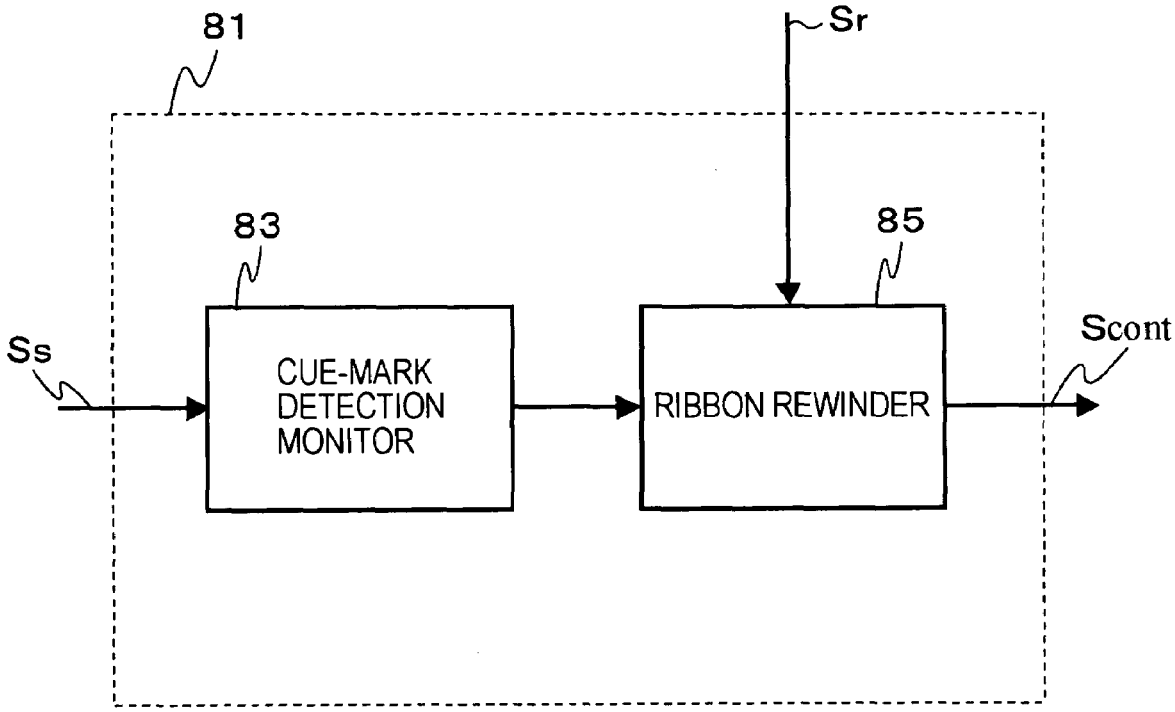
FIG. 6 is a diagram illustrating an example of the internal structure of a ribbon movement controller.

FIG. 6 shows an example of the internal structure of the ribbon movement controller 81. The ribbon movement controller 81 includes a cue-mark-detection monitor 83 and a ribbon rewinder 85.

The cue-mark-detection monitor 83 is a processing unit for monitoring the cue-mark detection performed by the mark detection sensor (phototransistor 61B) in parallel with winding of the ink ribbon 23. The cue-mark-detection monitor 83 checks the presence/absence of the cue mark by monitoring a detection signal Ss obtained by the phototransistor 61B included in the mark detection sensor.

The ribbon rewinder 85 is a processing unit for rewinding the ink ribbon 23 toward the feed reel 57 by a predetermined distance L3 (=L2−L1) after the detection of the cue mark, thereby positioning the ink ribbon 23 with respect to a print start position. Although the distances L1 and L2 include manufacturing errors to be precise, such an error is ignored here.

When the cue mark is detected, the ribbon rewinder 85 transmits a control signal Scont representing a command to start rewinding to the rewind motor 53. Then, when rewinding of the ink ribbon 23 is started, the ribbon rewinder 85 monitors the rewind amount of the ink ribbon 23 on the basis of a rotation-amount signal Sr input from the phototransistor 63B. Then, when the rewind amount reaches the predetermined distance L3 (=L2−L1), the ribbon rewinder 85 transmits a control Signal Scont representing a command to stop rewinding.

Even when the rewind amount is constant, the rotation amount corresponding to the rewind amount varies in accordance with the remaining amount of the ink ribbon 23 (the winding diameter of the feed reel 57). The remaining amount of the ink ribbon 23 can be obtained using a known detection method. For example, the remaining amount of the ink ribbon 23 can be determined by detecting the rotation amount (number of turns) of one or both of the take-up reel 55 and the feed reel 57 or the number of sheets subjected to printing.

Figure 7:
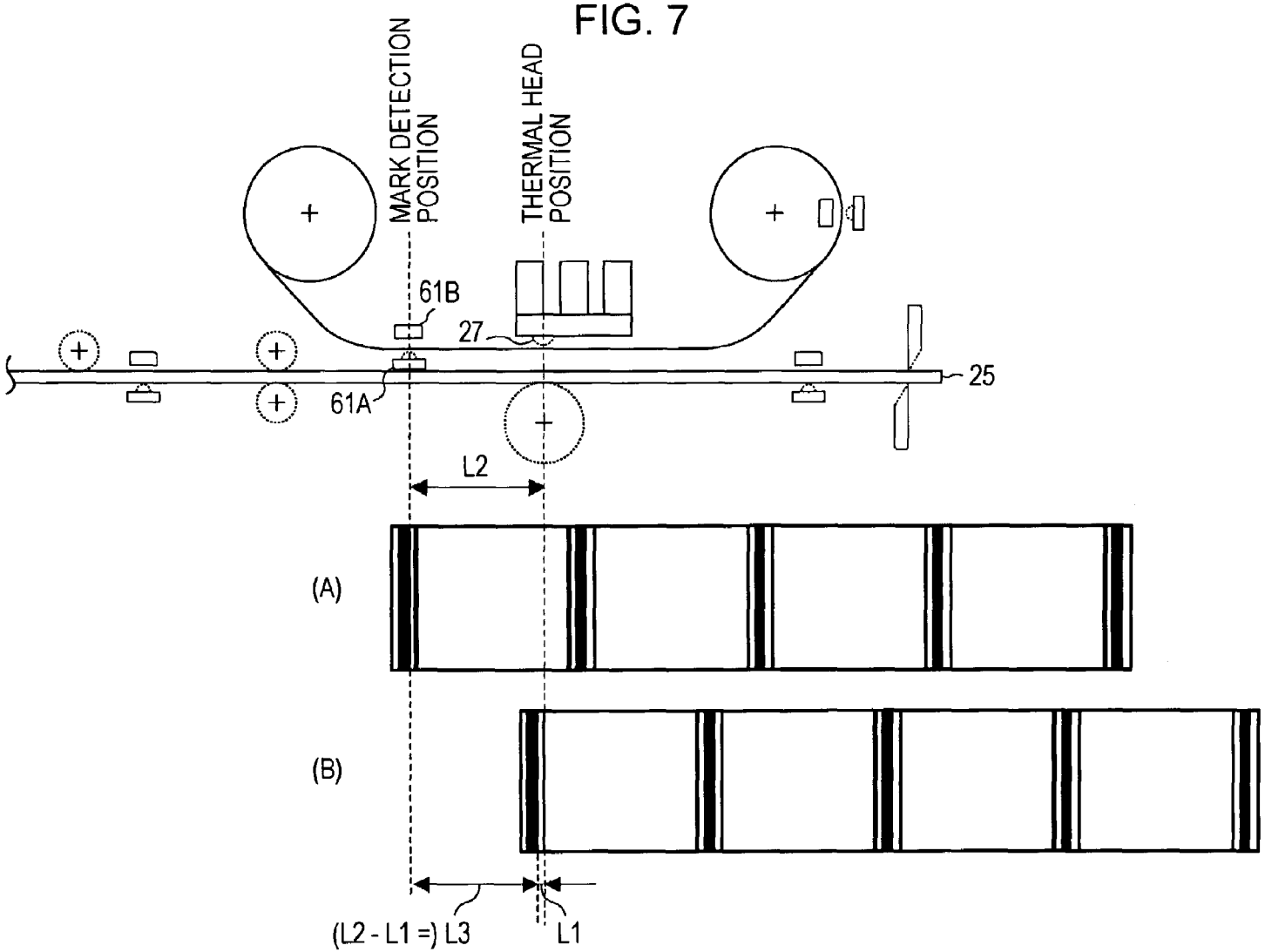
FIG. 7 is a diagram illustrating a process of positioning a transfer-material area by rewinding the ink ribbon.

FIG. 7 is a schematic diagram illustrating the operation of rewinding the ink ribbon 23 before starting a print operation using each transfer-material area. In FIG. 7, (A) shows the position of the ink ribbon at the time when a cue mark is detected and (B) shows the position of the ink ribbon at the time when the print operation is started after rewinding the ink ribbon.

As shown in FIG. 7, L2 is the distance between the transfer position of the thermal head 27 and the cue-mark detection position and L1 is the distance between the leading edge of each transfer-material area and the corresponding cue mark.

Due to the rewinding operation, although the distance L1 is not equal to the distance L2, the transfer-material area can be positioned at the print start position.

The rewind amount L3 is calculated or read out as the difference between the two distances L1 and L2 (=L2−L1) when the ink ribbon 23 is attached. If ink ribbons that may be used have only one kind of distance L1, the distance L3 corresponding thereto may be stored in a storage area in advance.

B-2. Print Operation a. Overall Print Operation

First, the overall print operation will be described. In the print operation, the recording sheet 25 is pulled out while being held between the pinch roller 33 and the capstan 35 and is guided to the area where the thermal head 27 is attached (transfer area).

After the recording sheet 25 is positioned with respect to the print start position, the thermal head 27 is moved downward so as to press the ink ribbon 23 and the recording sheet 25 against the platen roller 37.

At this time, the ink ribbon 23 is also guided by a guide roller (not shown) such that the leading edge of a group of transfer-material areas for the yellow ink (Y), the magenta ink (M), the cyan ink (C), and the laminate film (L) is positioned directly under the thermal head 27. The leading edge of this group of transfer-material areas corresponds to the leading edge of the transfer-material area for the yellow ink (Y).

Then, when grayscale data is input, the thermal printer selectively drives the heating elements included in the thermal head 27 while moving the recording sheet 25 forward. Accordingly, the ink on the ink ribbon 23 sublimates and a print pattern is transferred onto the recording sheet 25.

In color printing, the process of transferring the print pattern is performed for each color. Therefore, each time the ink ribbon 23 is moved forward and the color of ink to be transferred is changed, the pinch roller 33 and the capstan 35 are rotated in the reverse direction so that the leading edge of the recording sheet 25 returns to the print start position.

In the present embodiment, the recording sheet 25 is moved in the reverse direction each time the print pattern for yellow (Y), magenta (M), or cyan (C) is transferred onto the recording sheet 25.

Then, after the recording sheet 25 on which a color print pattern is formed is subjected to laminate processing, the recording sheet 25 is moved forward to the ejection hole and is cut at a predetermined position by the cutter 39.

Thus, the operation of printing on a single sheet of paper is completed.

Then, the recording sheet 25 is rewound again and the operation of positioning the leading edge of the recording sheet 25 at the print start position is performed.

b. Ink-Ribbon Movement Control

Next, a movement control operation for controlling the movement of the ink ribbon 23 will be described. This operation is suggested by the present inventors and is used for positioning each transfer-material area at the print start position.

Figure 8:
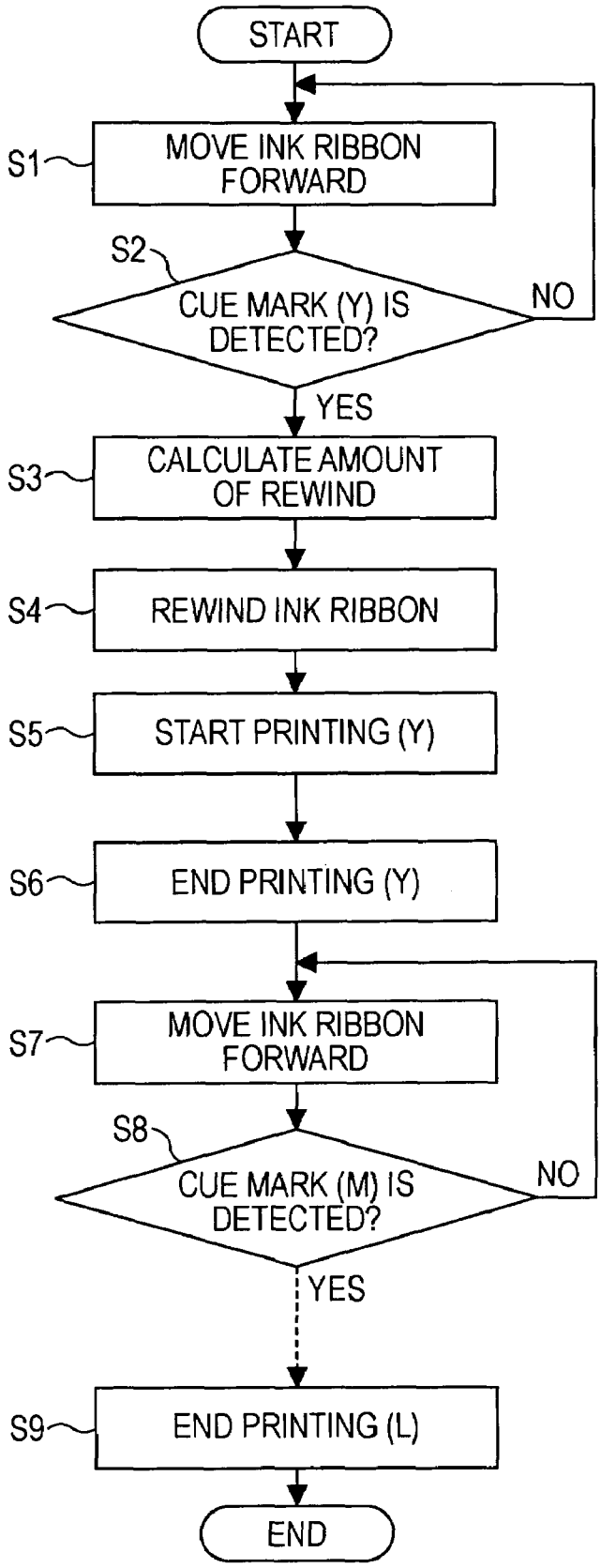
FIG. 8 is a diagram illustrating an example of a ribbon movement control process performed by the ribbon movement controller.

FIG. 8 shows a procedure of the movement control operation of the ink ribbon 23.

When a print command is input, the ribbon movement controller 81 rotates the take-up reel 55 and starts moving the ink ribbon 23 forward (S1).

Next, the ribbon movement controller 81 monitors the detection signal Ss obtained from the phototransistor 61B included in the mark detection sensor and determines the presence/absence of the cue mark 15 for yellow ink (Y) (S2). The determination step is repeated until the cue mark 15 is detected. During this time, the ink ribbon 23 is continuously moved forward.

When the cue mark 15 is detected by the mark detection sensor, the ribbon movement controller 81 stops the forward movement of the ink ribbon 23. At the same time, the ribbon movement controller 81 calculates the rewind amount for positioning the transfer-material area of the yellow ink (Y) at the print start position on the basis of the distance L3 (S3).

As described above, the rewind distance L3 is determined as the difference between the distance L2 from the transfer position of the thermal head to the cue-mark detection position and the distance L1 from the leading edge of each transfer-material area to the corresponding cue mark.

The rewind amount is converted into the number of turns of the feed reel 57 in the reverse direction (number of pulses of the rotation-amount signal Sr). The rewind amount varies in accordance with the winding diameter of the ink ribbon 23 around the feed reel 57.

Therefore, data regarding the remaining amount of the ink ribbon 23 is obtained by a known method. For example, the remaining amount of the ink ribbon 23 can be estimated on the basis of the number of sheets subjected to the print operation, the number turns of the reels in the forward direction, etc.

After the rewind amount (number of turns) is determined by calculation, the ribbon movement controller 81 rewinds the ink ribbon 23 by the amount corresponding to the determined number of turns, thereby positioning the transfer-material area of the yellow ink (Y) to a position directly under the thermal head 27 (S4).

More specifically, the ribbon movement controller 81 monitors the rotation-amount signal Sr input from the rotation-amount sensor (the light-emitting diode 63A and the phototransistor 63B) and stops rewinding the ink ribbon 23 when the amount of reverse rotation of the feed reel 57 after starting the rewinding operation reaches the desired number of turns.

After the transfer-material area of the yellow ink (Y) is positioned at the print start position, the thermal head 27 is moved downward and is pressed against the recording sheet 25 with the ink ribbon 23 placed therebetween. In this state, the operation of recording a print pattern for the yellow ink (Y) is started (S5).

Then, when the amount by which the recording sheet 25 (and the ink ribbon 23) is moved forward by the capstan 35 reaches a distance corresponding to the length of the transfer-material area, the print operation for the yellow ink (Y) is finished (S6). Then, the thermal head 27 is moved upward so that the ink ribbon 23 can be moved individually from the recording sheet 25.

Then, to perform the cue-mark detection for the next transfer-material area, that is, the transfer-material area of the magenta ink (M), the ribbon movement controller 81 rotates the take-up reel 55 again in the forward direction. In other words, the ink ribbon 23 is moved forward (S7).

Then, the ribbon movement controller 81 monitors the detection signal Ss obtained from the phototransistor 61B included in the mark detection sensor and determines the presence/absence of the cue mark 15 for magenta ink (M) (S8). The determination step is repeated until the cue mark 15 is detected. During this time, the ink ribbon 23 is continuously moved forward.

Then, when the cue mark 15 is detected, the ribbon movement controller 81 performs steps similar to S3 to S6 for the magenta ink (M).

Similarly, steps similar to S1 to S6 are performed for the cyan ink (C) and the laminate film (L).

Then, when the laminate printing is finished, the movement control operation of the ink ribbon 23 for a single printing process is ended (S9).

After the laminate printing, the recording sheet 25 is ejected.

Figure 9:
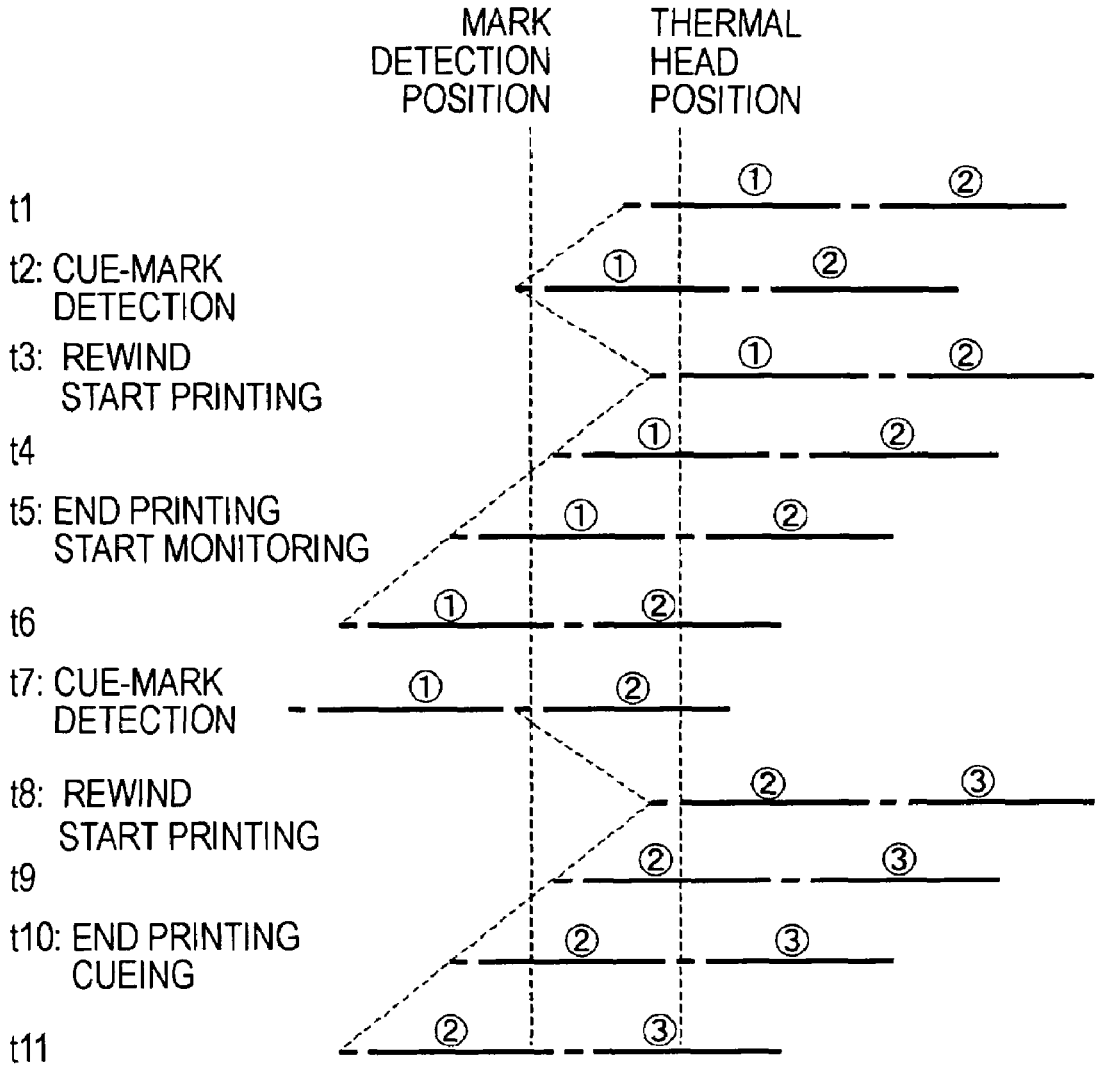
FIG. 9 is a diagram illustrating an example of the manner in which the ink ribbon is moved.

FIG. 9 is a schematic diagram illustrating the manner in which the ink ribbon is moved in the above-described movement control. The positional relationship among the mark detection position, the thermal head position, and the areas of the ink ribbon is shown in FIG. 9.

In FIG. 9, time points t1 to t5 correspond to the movement operation of the ink ribbon performed while a transfer-material area 1 is used in the print operation.

Referring to FIG. 9, the ink ribbon is moved forward until the cue mark is detected, is rewound until the leading edge of the transfer-material area 1 is positioned, and is moved forward again during printing.

Time points t6 to t10 correspond to the movement operation of the ink ribbon performed while a transfer-material area 2 is used in the print operation.

Similar to the case in which the transfer-material area 1 is used, the ink ribbon is moved forward until the cue mark is detected, is rewound until the leading edge of the transfer-material area 2 is positioned, and is moved forward again during printing.

C. Advantages Obtained by the Embodiment

According to the known method, the ink ribbon is designed such that the leading edge of each transfer-material area 3 is positioned directly under the thermal head 27 at the time when the corresponding cue mark 1 is detected. Therefore, the distance L1 between the leading edge of each transfer-material area 3 and the corresponding cue mark 1 is set to be equal to the distance L2 between the attachment position of the thermal head 27 and the attachment position of the mark detection sensor (61A and 61B).

Therefore, according to the known method, the size of the margin areas 5 that do not contribute to the print operation is increased as the distance L2 is increased, and the total length of the ink ribbon is increased accordingly.

In comparison, the thermal printer according to the present embodiment has a control function for positioning the leading edge of each transfer-material area 11 at a position directly under the thermal head 27 by rewinding the ink ribbon 23 by a predetermined distance L3 (=L1−L2) after detecting the corresponding cue mark 15.

Therefore, the distance L1 between the leading edge of each transfer-material area 11 and the corresponding cue mark 15 can be minimized.

Accordingly, the size of the areas in the base film that do not contribute to printing (i.e., the margin areas 13) can be minimized and the consumption of the base film can be reduced. As a result, the total length of the ink ribbon can be reduced without reducing the number of sheets that can be printed on, and the winding diameter of the ink ribbon can be reduced accordingly. The reduction in the consumption of the base film contributes not only to a reduction in the manufacturing cost but also to a reduction in the overall size of a ribbon cassette, which leads to a reduction in the size of a housing of the thermal printer.

As the detection accuracy expected in the above-described movement control method and the feed accuracy of the ink ribbon are increased, the size of a margin provided in each transfer-material area can be minimized. Therefore, the transfer material can be used efficiently and the environmental load can be reduced.

In the known method, the distance L2 between the attachment position of the thermal head 27 and that of the mark detection sensor is set as small as possible in order to reduce the size of each margin area in the ink ribbon 23. Thus, the attachment positions of the thermal head 27 and the mark detection sensor are limited.

In comparison, when the movement control method according to the present embodiment is used, the limitation to the distance L2 is removed and there is more freedom in the spatial layout of the components.

D. Other Embodiments (a) The structure of the ink ribbon that allows color printing and laminate processing is described in the above-described embodiment.

However, the structure in which the distance L1 between the leading edge of each transfer-material area and the corresponding cue mark (that is, the length L0 of each margin area 13) is set to be smaller than the distance L2 between the attachment position of the thermal head 27 and that of the mark detection sensor may be applied to other kinds of ink ribbons.

For example, the above-described structure may also be applied to ink ribbons for color printing with which laminate processing is not performed. In such a case, transfer-material areas for yellow ink (Y), magenta ink (M), and cyan ink (C) form a group, and the transfer-material areas for the three colors are repeatedly arranged on the base film.

Although three-color printing is described above as an example, the above-described structure may also be applied to color printing using four or more colors including black (K). In addition, the above-described structure may also be applied to ink ribbons for arbitrary multi-color printing depending on the use.

Figure 16:
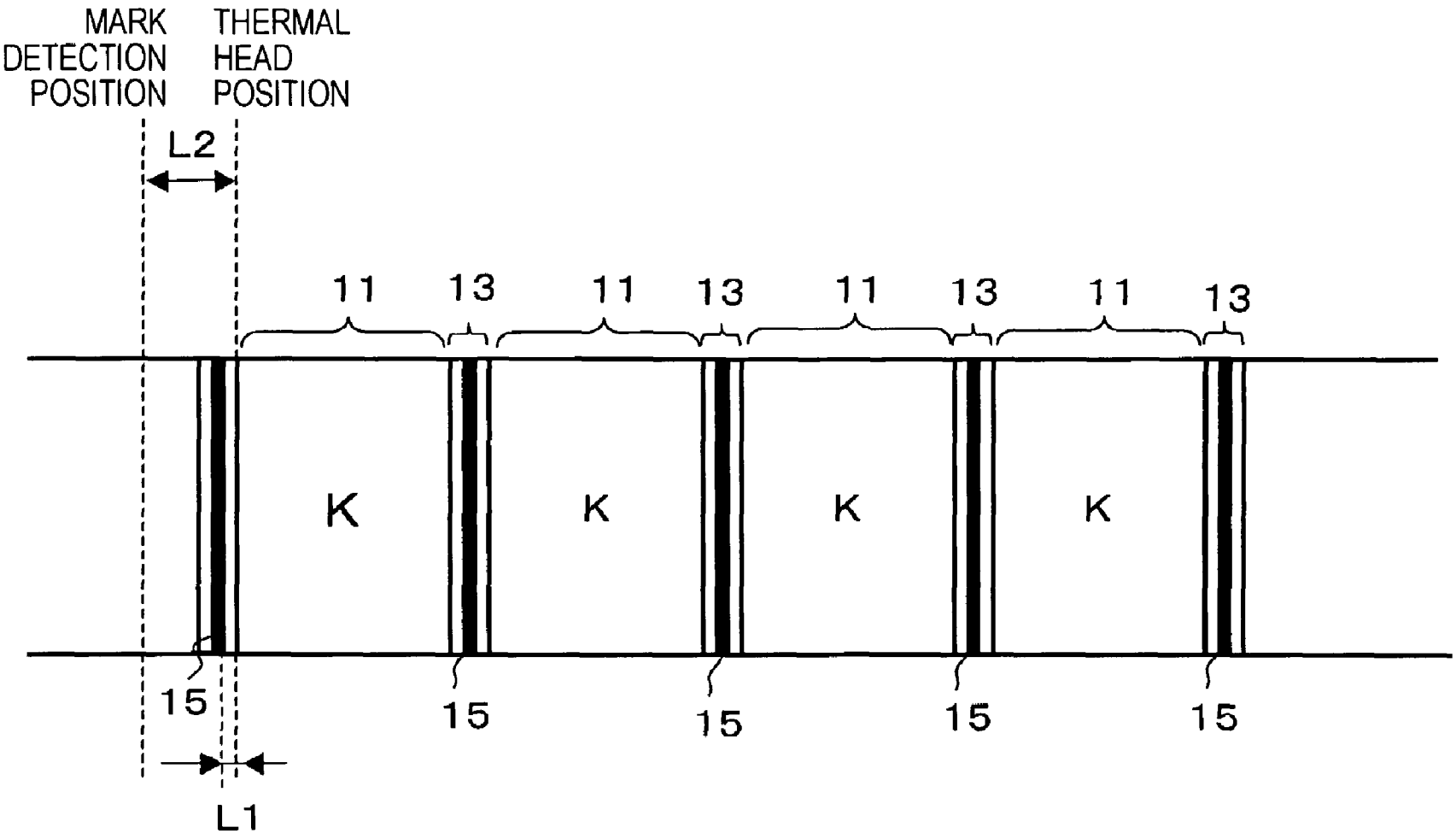
FIG. 16 is a diagram illustrating another example of the structure of an ink ribbon.

The above-described structure may also be applied to ink ribbons for single-color printing. FIG. 16 shows the structure of an ink ribbon that allows printing using black ink (K) only. As shown in the figure, all of the transfer-material areas correspond to black ink (K).

The color of the ink is, of course, not limited to black (K), and may also be yellow (Y), magenta (M), cyan (C), and other colors. In addition, the above-described structure may also be applied to a ribbon film dedicated to laminate processing.

(b) In the above-described embodiment, all of the cue marks for the transfer-material areas have the same shape.

However, the cue marks may have different shapes depending on the kinds of the corresponding transfer-material areas and the positional relationships therebetween.

For example, in a group of transfer-material areas used for printing on a single sheet, the shape of the cue mark for the first transfer-material area may be different from that of the cue marks for the second and following transfer-material areas.

Figure 17:
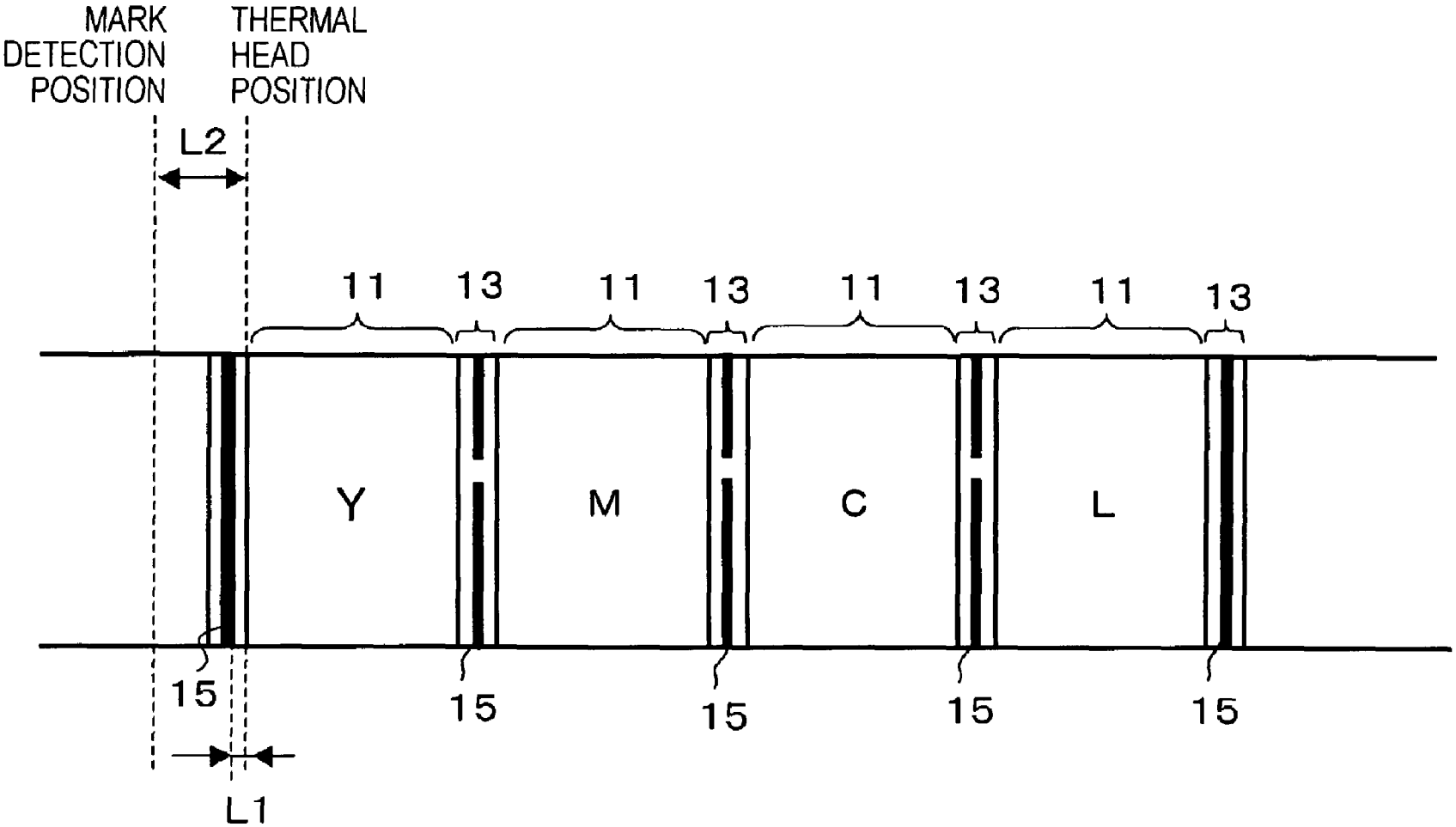
FIG. 17 is a diagram illustrating another example of the structure of an ink ribbon.

FIG. 17 shows the structure of an ink ribbon having such an arrangement. According to this arrangement, the phase of the ink ribbon can be recognized. For example, if a black bar extending across the ink ribbon but having a cutout in an intermediate position thereof is detected in the cue-mark detection performed before starting the print operation, the phase displacement can be detected before starting the print operation. In this case, the ink ribbon is moved forward until a bar without a cutout that extends across the ink ribbon is detected.

(c) In the above-described embodiment, each cue mark 15 is positioned at substantially the center of the corresponding margin area 13.

Figure 18:
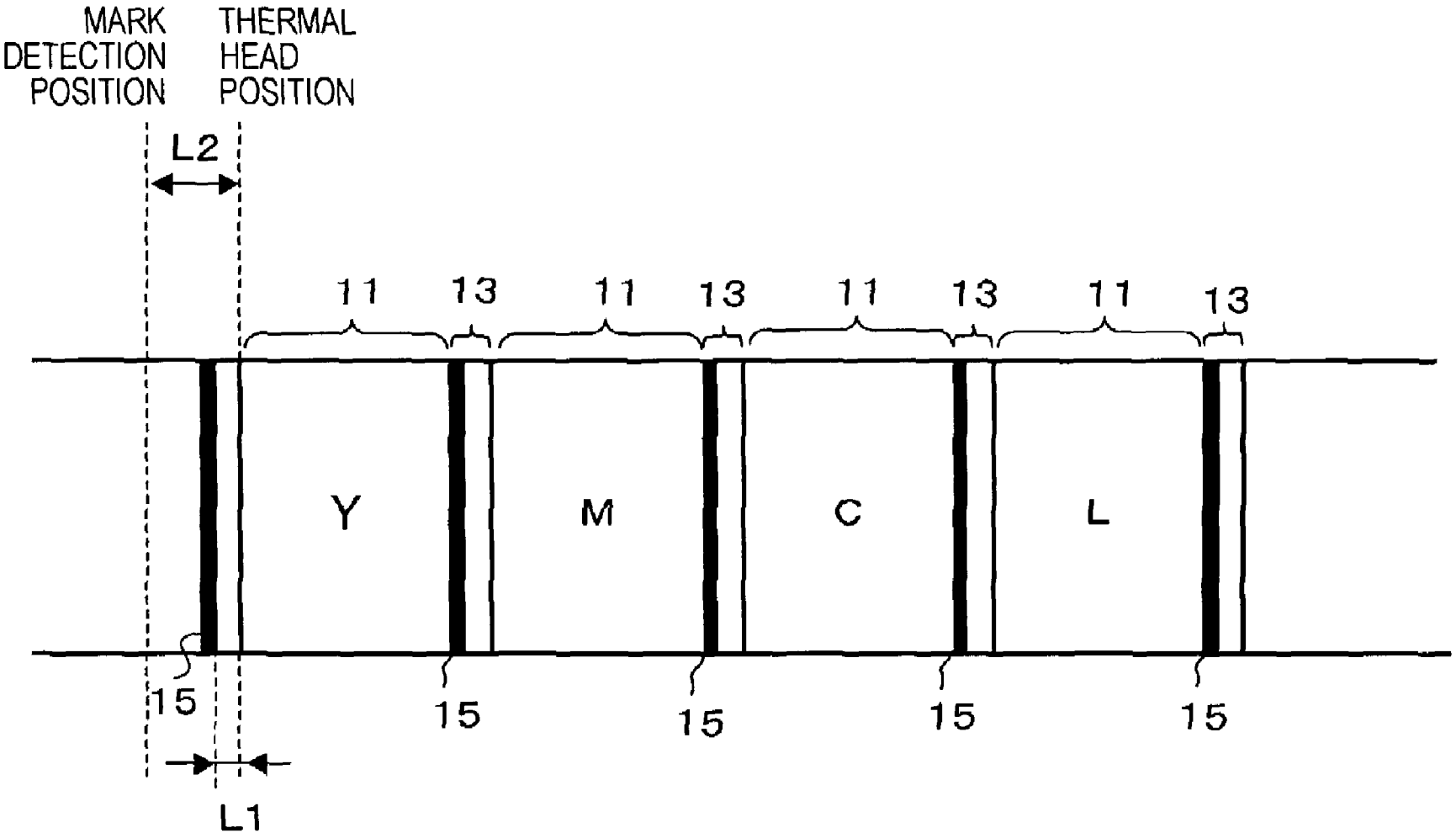
FIG. 18 is a diagram illustrating another example of the structure of an ink ribbon.

However, the position of each cue mark 15 is not limited as long as it is located within the corresponding margin area 13. For example, each cue mark 15 may be positioned at the leading edge of the corresponding margin area 13, as shown in FIG. 18. Alternatively, each cue mark 15 may also be positioned at the trailing edge of the corresponding margin area 13.

(d) In the above-described embodiment, transmissive sensors are used as the sensors installed in the thermal printer. However, other sensors, such as reflective sensors, may also be used.

(e) Although the dye-sublimation thermal printer is explained in the above-described embodiment, the structure of the above-described embodiment may also be applied to thermal printers using a melting method or a thermosensitive method.

(f) In the above-described embodiment, the ribbon movement controller 81 is provided as a hardware structure. However, a function similar to that of the ribbon movement controller 81 may also be obtained by causing a microprocessor (arithmetic unit) to perform a corresponding signal process.

(g) In the above-described embodiment, the recording sheet 25 is continuous and is wound in the form of a roll. However, the present invention may also be applied to the case in which a recording sheet is fed manually or a plurality of recording sheets are fed one sheet at a time.

(h) The above-described movement control program may be distributed via a network, or be distributed in the form of a storage medium in which the program is stored. The storage medium may be a magnetic storage medium, an optical storage medium, a semiconductor storage medium, etc.

(i) The above-described embodiment may be variously modified within the gist of the present invention. In addition, there may be various modifications and applications created based on the description of this specification.

Second Embodiment

In a second embodiment, the leading edge of a transfer-material area is positioned by the following method. That is, first, the length of an unprocessed portion of a transfer-material area that is being subjected to print operation is determined on the basis of the ink-ribbon format at the time when a cue mark corresponding to the transfer-material area is detected. Then, the sum of the length of the unprocessed portion and the length of each margin area is calculated. Then, the amount by which the ink ribbon is moved during a period between the detection of the cue mark and the end of the print operation is subtracted from the above obtained sum. Then, the ink ribbon is moved forward by an amount corresponding to the result of subtraction. Accordingly, the leading edge of the next transfer-material area is positioned.

Figure 10:
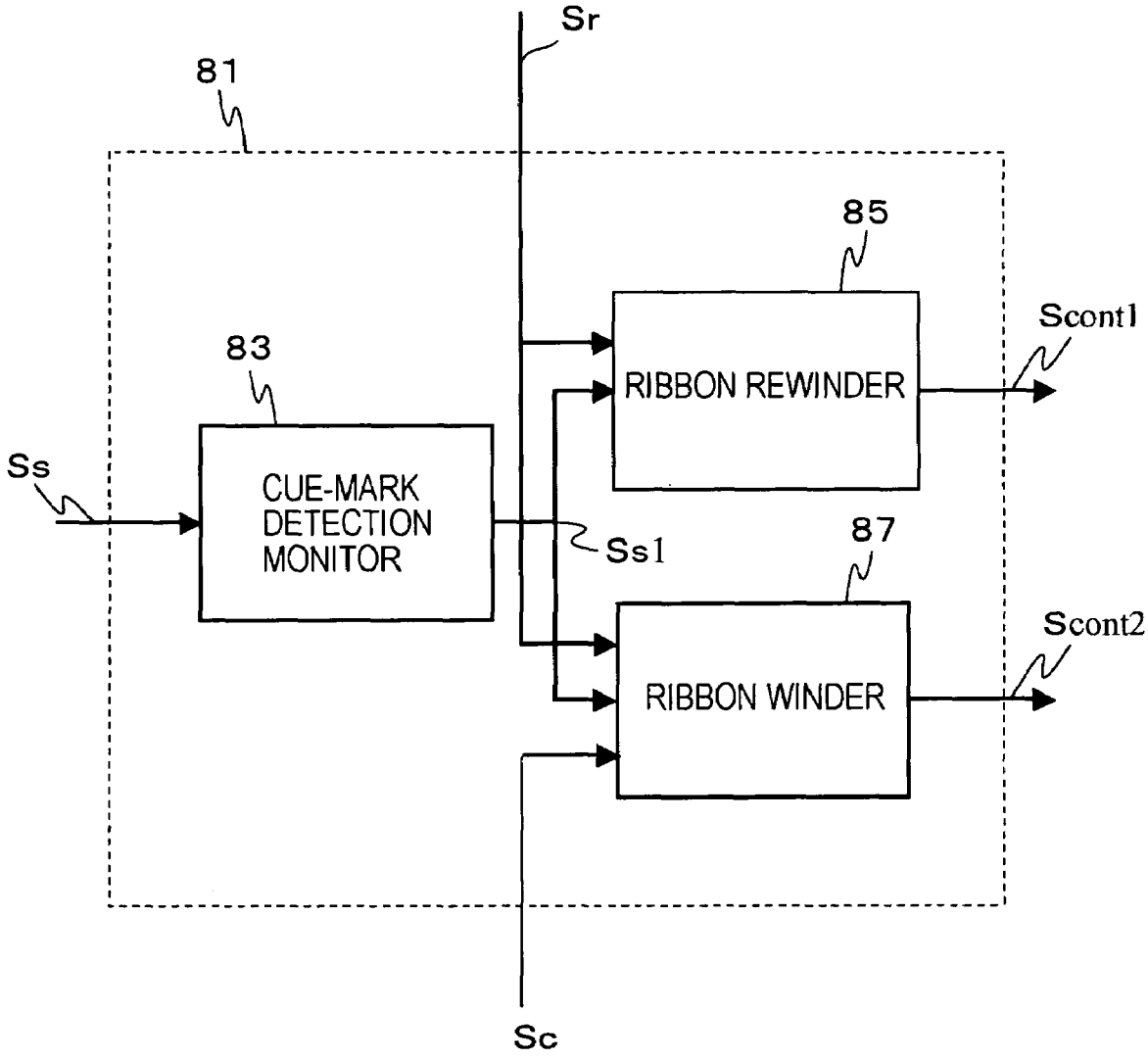
FIG. 10 is a diagram illustrating another example of the internal structure of a ribbon movement controller.

FIG. 10 shows the internal structure of a ribbon movement controller 81 according to the present embodiment. The ribbon movement controller 81 includes a cue-mark-detection monitor 83, a ribbon rewinder 85, and a ribbon feeder 87.

The cue-mark-detection monitor 83 is a processing unit for monitoring cue-mark detection performed by a mark detection sensor (phototransistor 61B) in parallel with winding of the ink ribbon 23. The winding operation includes winding performed for cueing before starting the print operation (as described below, there are two kinds of cueing in practice) and winding performed during the print operation.

The cue-mark-detection monitor 83 checks the presence/absence of the cue mark by monitoring a detection signal Ss obtained by the phototransistor 61B included in the mark detection sensor.

The ribbon rewinder 85 is a processing unit for rewinding the ink ribbon 23 toward the feed reel 57 by a predetermined distance L3 (=L2−L1) after the detection of the cue mark corresponding to the transfer-material area to be used first in a single printing process (the transfer-material area of the yellow ink (Y) in the present embodiment), thereby positioning the ink ribbon 23 with respect to a print start position. Although the distances L1 and L2 include manufacturing errors to be precise, such an error is ignored here.

When the cue mark is detected, the ribbon rewinder 85 transmits a control signal Scont1 representing a command to start rewinding to the rewind motor 53.

Then, when rewinding of the ink ribbon 23 is started, the ribbon rewinder 85 monitors the rewind amount of the ink ribbon 23 on the basis of a rotation-amount signal Sr input from the phototransistor 63B. Then, when the rewind amount reaches the predetermined distance L3 (=L2−L1), the ribbon rewinder 85 transmits a control Signal Scont1 representing a command to stop rewinding.

Even when the rewind amount is constant, the rotation amount corresponding to the rewind amount varies in accordance with the remaining amount of the ink ribbon 23 (the winding diameter of the feed reel 57). The remaining amount of the ink ribbon 23 can be obtained using a known detection method. For example, the remaining amount of the ink ribbon 23 can be determined by detecting the rotation amount (number of turns) of one or both of the take-up reel 55 and the feed reel 57 or the number of sheets subjected to printing.

Next, the ribbon feeder 87 will be described. The ribbon feeder 87 is a processing unit for positioning the transfer-material areas used in the second and following cycles in a single printing process (that is, the transfer-material areas for the magenta ink (M), the cyan ink (C), and the laminate film (L) in the present embodiment).

Figure 11:
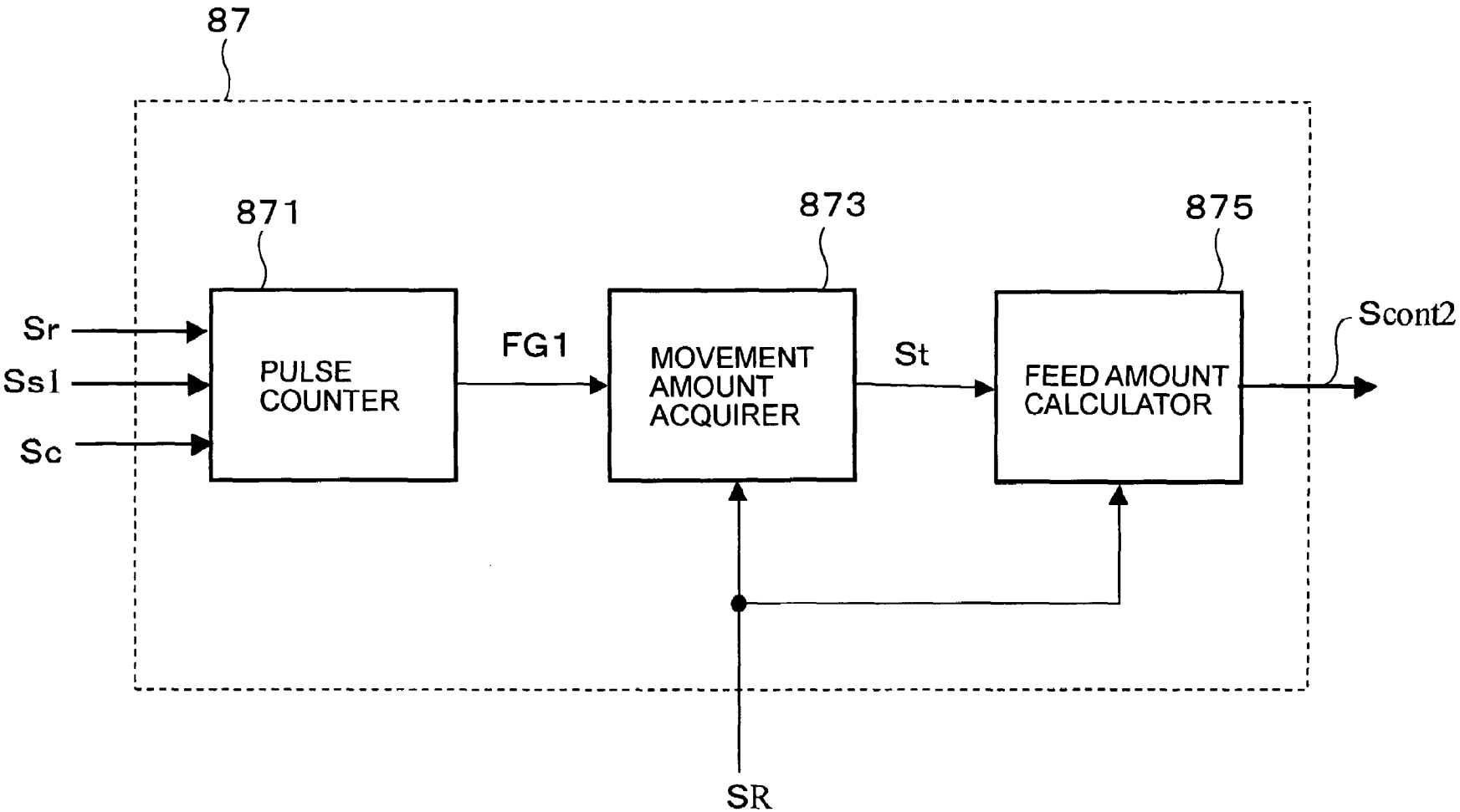
FIG. 11 is a diagram illustrating an example of the internal structure of a ribbon feeder.

FIG. 11 shows an example of the internal structure of the ribbon feeder 87. The ribbon feeder 87 includes a pulse counter 871, a movement amount acquirer 873, and a feed amount calculator 875.

The pulse counter 871 is a processing unit that calculates the amount by which the feed reel 57 is rotated (the number of pulses of the rotation-amount signal Sr) during a period between the detection of the cue mark 15 in the print operation using a certain transfer-material area and the end of the print operation.

The detection of the cue mark 15 is informed by the cue-mark detection signal Ss output from the cue-mark-detection monitor 83. The end of the print operation using the corresponding transfer-material area is informed by a rotation signal obtained from the capstan 35.

The number of counts obtained in the above-mentioned period is supplied to the movement amount acquirer 873 as a count value FG1.

In the present embodiment, the count value of the pulse counter 871 is reset at the time when the cue mark 15 is detected. In other words, the count value is reset each time the print operation using a new transfer-material area is performed. Therefore, the count value FG1 is not affected by the measurement results for other transfer-material areas. This means that propagation of error can be canceled.

In addition, during the above-described period, the ink ribbon 23 and the recording sheet 25 are moved while being pressed against each other. Therefore, the amount of rotation of the feed reel 57 accurately reflects the amount of movement of the ribbon film.

The movement amount acquirer 873 is a processing unit that determines the movement amount St by which the ribbon film is moved in the period between the detection of the cue mark and the end of the print operation using the transfer-material area corresponding to the cue mark. The movement amount acquirer 873 receives the remaining amount information SR of the ink ribbon 23 that can be determined by known detection methods as mentioned above. For example, the winding diameter of the feed reel 57 is given as the remaining amount information SR.

The movement amount acquirer 873 converts the count value FG1 into the movement amount St using the remaining amount information SR.

The feed amount calculator 875 is a processing unit that calculates the feed amount by which the ink ribbon 23 is to be moved forward for positioning the leading edge of the next transfer-material area at the print start position.

The feed amount is calculated on the basis of the format regarding the size of the ink ribbon and the distance L2 between the transfer position of the thermal head and the detection position of the cue mark. More specifically, the fact that the length L4 between the transfer position of the thermal head 27 and the leading edge of the next transfer-material area 11 is determined as a fixed length at the time when the cue mark 15 is detected is used.

The fixed length L4 is equal to the sum of the length of the unprocessed portion of the transfer-material area and the length of each margin area.

The feed amount calculator 875 calculates a feed amount L5 by subtracting the movement amount St from the fixed length L4.

Figure 12A:
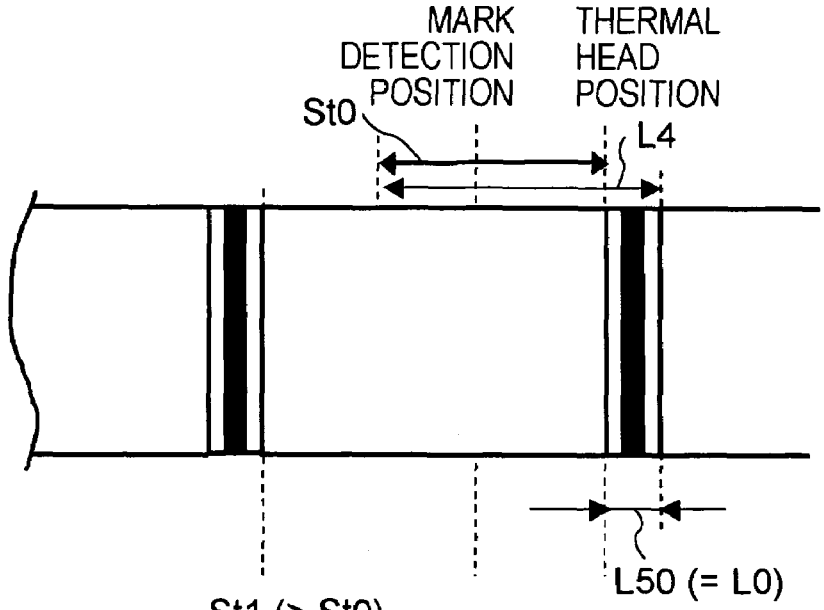
FIG. 12A to 12C are diagrams illustrating calculation images of feed amount.
Figure 12B:
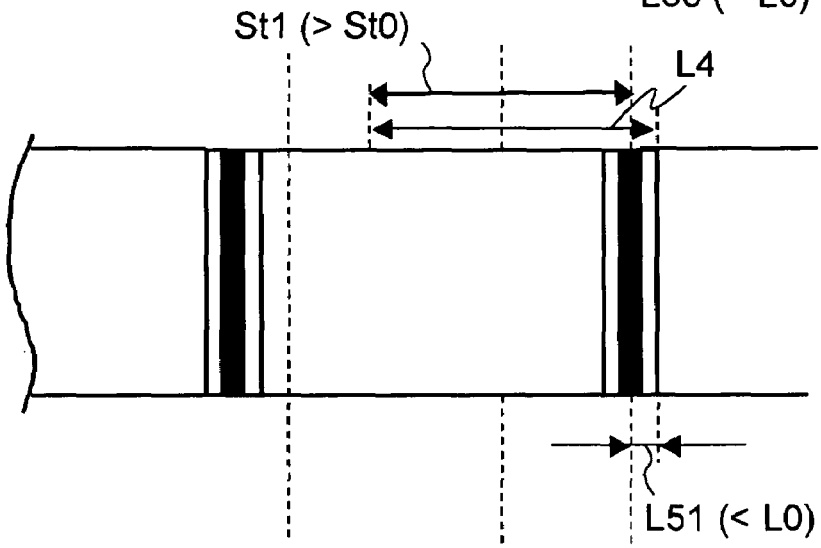
Figure 12C:
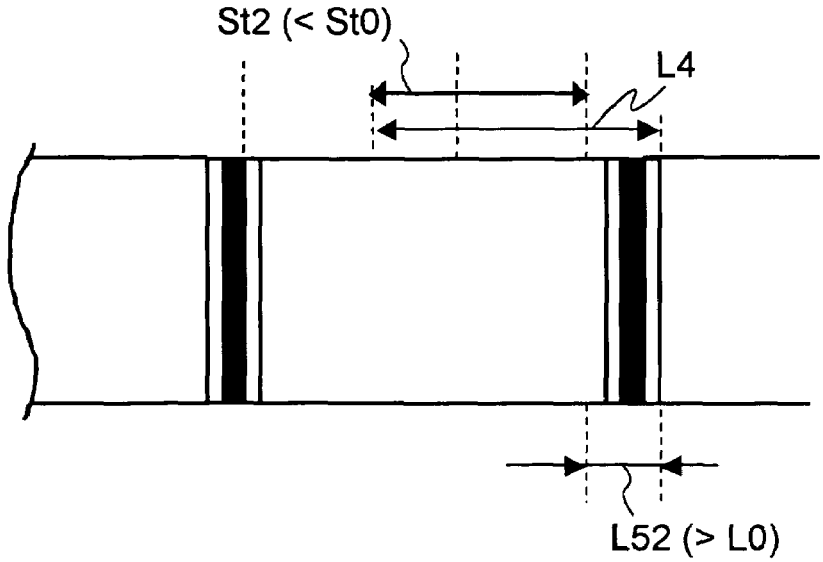

FIG. 12A to 12C are diagrams illustrating calculation images of feed amount L5.

FIG. 12A shows the case in which the ribbon film is positioned without a displacement. In this case, the trailing edge of the transfer-material area is at the thermal head position when the print operation ends. Therefore, the feed amount L50 obtained by subtracting the movement amount St0 from the fixed length L4 is equal to the width L0 of the margin area 13.

FIG. 12B shows the case in which the leading edge of the transfer-material area is displaced downstream when the print operation using the ribbon film is started. In this case, the trailing edge of the transfer-material area is positioned downstream of the thermal head position when the print operation ends. In addition, since the cue mark 15 reaches the mark detection position earlier compared to the case in which there is no displacement, the movement amount St1 is larger than that compared to the case in which there is no displacement. In FIG. 12B, a portion of the margin area 13 is positioned under the thermal head.

In this case, the feed amount L51 obtained by subtracting the movement amount St1 from the fixed length L4 is smaller than the width L0 of the margin area 13.

FIG. 12C shows the case in which the leading edge of the transfer-material area is displaced upstream when the print operation using the ribbon film is started. In this case, the trailing edge of the transfer-material area is positioned upstream of the thermal head position when the print operation ends. In addition, since the cue mark 15 reaches the mark detection position later compared to the case in which there is no displacement, the movement amount St2 is smaller than that compared to the case in which there is no displacement. In FIG. 12C, a portion of the transfer-material area 11 is positioned under the thermal head. In this case, the feed amount L51 obtained by subtracting the movement amount St2 from the fixed length L4 is larger than the width L0 of the margin area 13.

Thus, even when a displacement is generated when the leading edge of one of the transfer-material areas 11 is positioned at the print start position, the influence of the displacement is exerted only on that transfer-material area 11 and other transfer-material areas 11 can be prevented from being affected.

This is because the amount of rotation of the feed reel 57 (the number of pulses) is reset at the time when the cue mark 15 is detected, as described above.

Next, a movement control operation for controlling the movement of the ink ribbon 23 will be described. This operation is suggested by the present inventors and is used for positioning each transfer-material area at the print start position.

Figure 13:
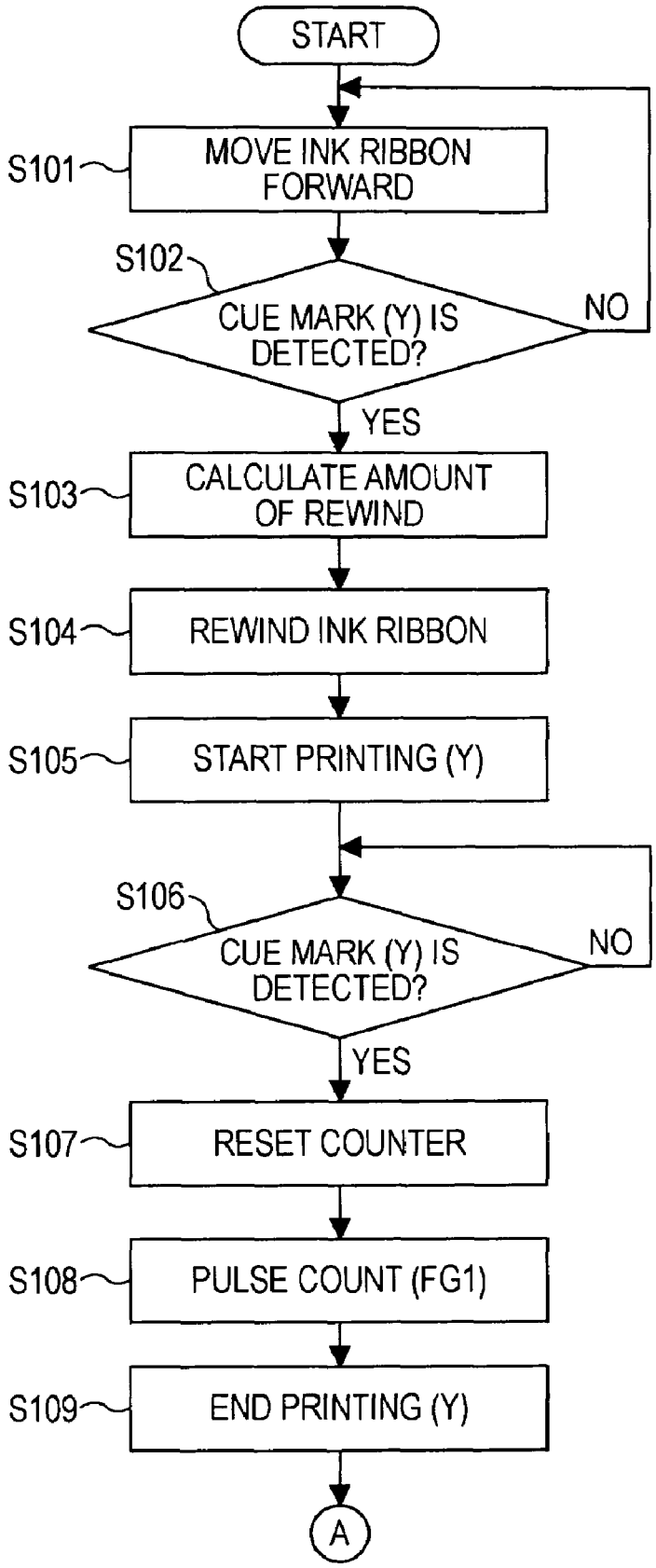
FIG. 13 is a diagram illustrating steps of another example of a ribbon movement control process performed by the ribbon movement controller.
Figure 14:
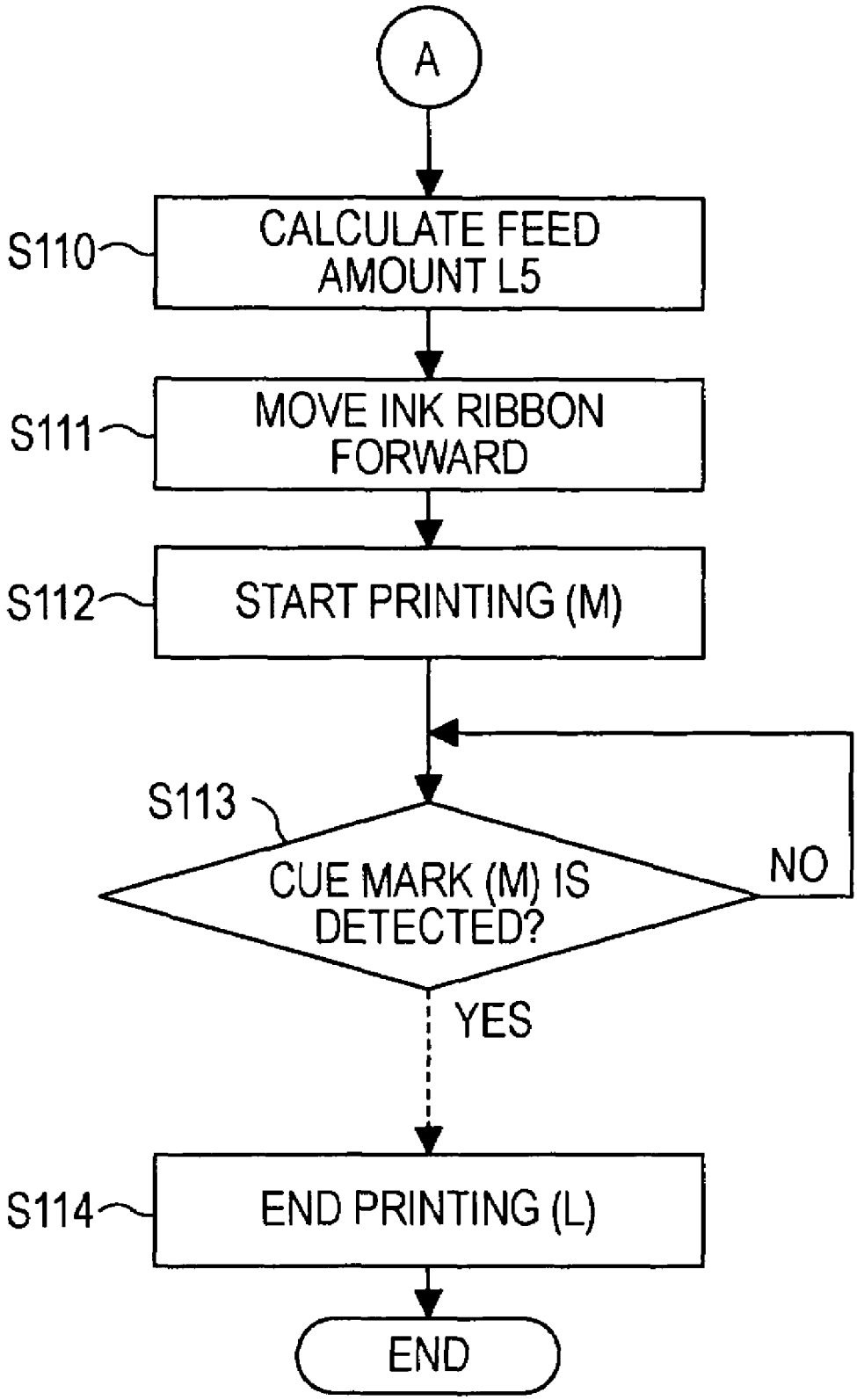
FIG. 14 is a diagram illustrating steps of the ribbon movement control process performed after the steps shown in FIG. 13.

FIGS. 13 and 14 show a procedure of the movement control operation of the ink ribbon 23.

When a print command is input, the ribbon movement controller 81 rotates the take-up reel 55 and starts moving the ink ribbon 23 forward (S101).

Next, the ribbon movement controller 81 monitors the detection signal Ss obtained from the phototransistor 61B included in the mark detection sensor and determines the presence/absence of the cue mark 15 for yellow ink (Y) (S102). The determination step is repeated until the cue mark 15 is detected. During this time, the ink ribbon 23 is continuously moved forward.

When the cue mark 15 is detected by the mark detection sensor, the ribbon movement controller 81 stops the forward movement of the ink ribbon 23. At the same time, the ribbon movement controller 81 calculates the rewind amount for positioning the transfer-material area of the yellow ink (Y) at the print start position on the basis of the distance L3 (S103).

As described above, the rewind distance L3 is determined as the difference between the distance L2 from the transfer position of the thermal head to the cue-mark detection position and the distance L1 from the leading edge of each transfer-material area to the corresponding cue mark.

The rewind amount is converted into the number of turns of the feed reel 57 in the reverse direction (number of pulses of the rotation-amount signal Sr). The rewind amount varies in accordance with the winding diameter of the ink ribbon 23 around the feed reel 57.

Therefore, data regarding the remaining amount of the ink ribbon 23 is obtained by a known method. For example, the remaining amount of the ink ribbon 23 can be estimated on the basis of the number of sheets subjected to the print operation, the number turns of the feed reel or the take-up reel in the forward direction, etc.

After the rewind amount (number of turns) is determined by calculation, the ribbon movement controller 81 rewinds the ink ribbon 23 by the amount corresponding to the determined number of turns, thereby positioning the transfer-material area of the yellow ink (Y) to a position directly under the thermal head 27 (S104).

More specifically, the ribbon movement controller 81 monitors the rotation-amount signal Sr input from the rotation-amount sensor (the light-emitting diode 63A and the phototransistor 63B) and stops rewinding the ink ribbon 23 when the amount of reverse rotation of the feed reel 57 after starting the rewinding operation reaches the desired number of turns.

After the transfer-material area of the yellow ink (Y) is positioned at the print start position, the thermal head 27 is moved downward and is pressed against the recording sheet 25 with the ink ribbon 23 placed therebetween. In this state, the operation of recording a print pattern for the yellow ink (Y) is started (S105).

Then, the ribbon movement controller 81 determines whether or not the cue mark 15 is detected (S106). The determination is repeated until the cue mark 15 is detected.

When the cue mark 15 is detected, that is, when the result of determination in step S106 is YES, the ribbon movement controller 81 resets the counter for counting the amount of rotation of the feed reel 57 and starts counting the number of pulses input from the phototransistor 63B (S107 and S108). Thus, the count value FG1 is determined.

Then, when the amount by which the recording sheet 25 (and the ink ribbon 23) is moved forward by the capstan 35 reaches a distance corresponding to the size of the transfer-material area, the print operation for the yellow ink (Y) is finished (S109). Then, the thermal head 27 is moved upward so that the ink ribbon 23 can be moved individually from the recording sheet 25.

After or in parallel with the process of moving the thermal head 27 upward, the ribbon movement controller 81 calculates the feed amount L5 for positioning the leading edge of the transfer-material area of the magenta ink (M), which is the next transfer-material area, at the print start position (S110).

After the feed amount L5 is calculated, the ribbon movement controller 81 moves the ink ribbon 23 forward by the rotation amount corresponding to the feed amount L5 (S111). During this time, the ribbon movement controller 81 monitors the rotation of the feed reel 57 and stops the forward movement when the rotation amount represented by the rotation-amount signal Sr reaches the desired rotation amount. Thus, the leading edge of the transfer-material area 11 of the magenta ink (M) is positioned at the print start position.

When the transfer-material area 11 of the magenta ink (M) is positioned at the print start position, the thermal head 27 is moved downward again and is pressed against the recording sheet 25 with the ink ribbon placed therebetween. In this state, the operation of recording a print pattern for the magenta ink (M) is started (S112).

Then, similar to the print operation of the yellow ink (Y), the ribbon movement controller 81 determines whether or not the cue mark 15 is detected (S113). The determination is repeated until the cue mark 15 is detected.

Then, when the cue mark 15 is detected, the ribbon movement controller 81 performs steps similar to S107 to S109 for the magenta ink (M).

Next, the ribbon movement controller 81 performs steps similar to S110 and S111 to position the leading edge of the transfer-material area 11 of the cyan ink (C) at the print start position.

Then, similar steps are performed for the cyan ink (C) and the laminate film (L).

Then, when the laminate printing is finished, the movement control operation of the ink ribbon 23 for a single printing process is ended (S114).

Then, when the laminate printing is finished, the recording sheet 25 is ejected.

Figure 15:
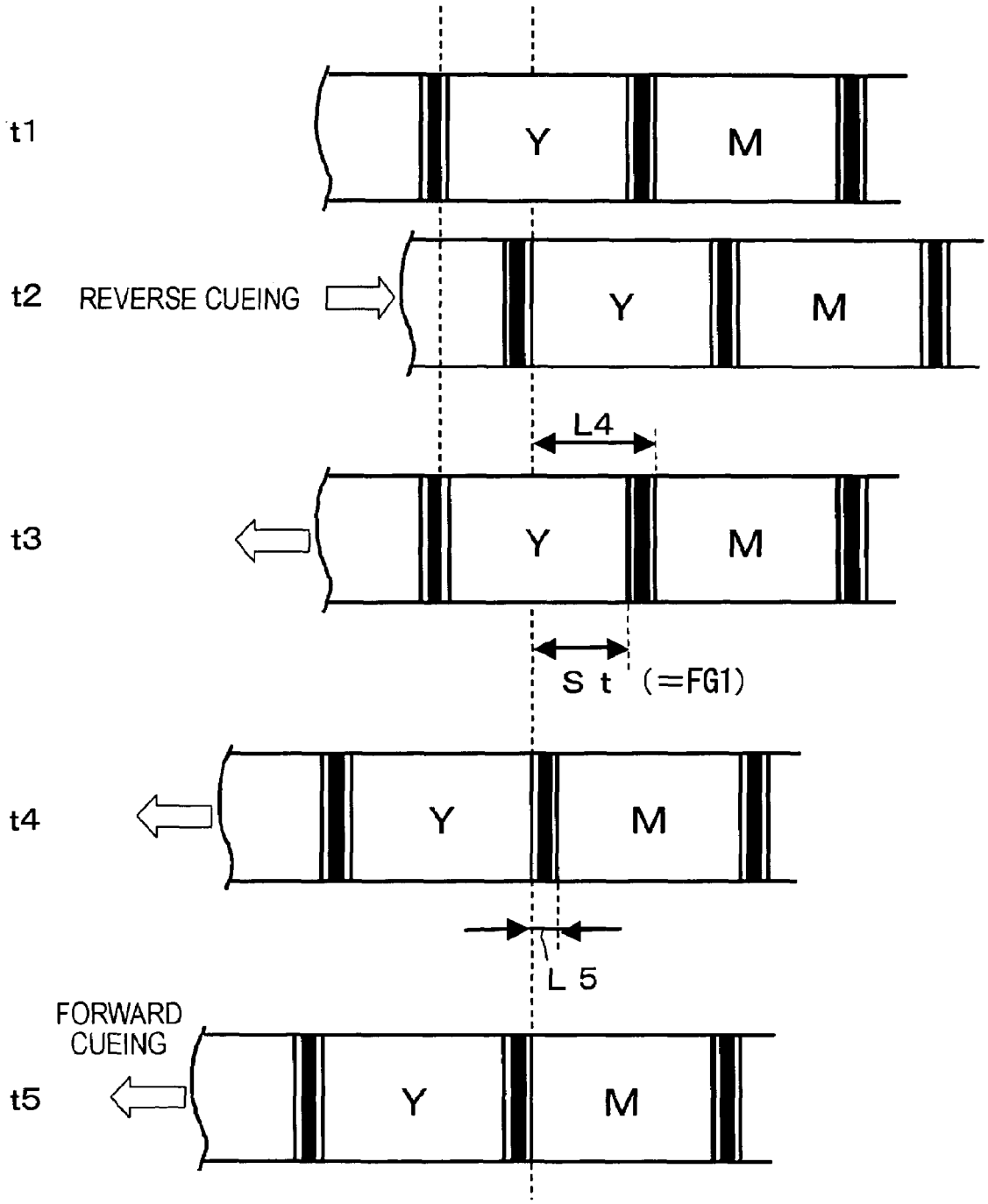
FIG. 15 is a diagram illustrating another example of the manner in which the ink ribbon is moved.

FIG. 15 is a schematic diagram illustrating the manner in which the ink ribbon is moved in the above-described movement control. The positional relationship among the mark detection position, the thermal head position, and the areas of the ink ribbon is shown in FIG. 15.

In FIG. 15, time points t1 to t5 correspond to the cueing operation of the ink ribbon 23 for the yellow ink (Y) and the magenta ink (M).

As shown in FIG. 15, in the cueing operation for the yellow ink (Y), the ink ribbon is moved forward until the cue mark 15 is detected and is rewound until the leading edge of the transfer-material area is positioned.

The time point t2 corresponds to the state in which the leading edge of the transfer-material area of the yellow ink (Y) is positioned.

After the operation of printing a print pattern corresponding to the yellow ink (Y) is started, the ink ribbon 23 is moved together with the recording sheet 25.

The time point t3 corresponds to the state in which the cue mark 15 corresponding to the transfer-material area for the yellow ink (Y) is detected while the print pattern corresponding to the yellow ink (Y) is performed.

At the time point t3, the distance between the print start position and the leading edge of the transfer-material area of the magenta ink (M) is L4.

At the time point t3, the count value for determining the amount of rotation of the feed reel 57 is reset and is then incremented until the end of the print operation for the yellow ink (Y). The thus obtained count value corresponds to the movement amount St. As described above, the movement amount St varies depending on whether or not there is a positioning error at the time when the print operation is started.

When the operation of printing the print pattern corresponding to the yellow ink (Y) is ended at the time point t4, the feed amount L5 for positioning the leading edge of the transfer-material area of the magenta ink (M) at the print start position is determined.

The time point t5 corresponds to the state in which the operation of moving the ink ribbon 23 forward by the feed amount L5 is finished. The operation of cueing by moving the ink ribbon 23 forward is also performed for the cyan ink (C) and the laminate film (L).

According to the known method, the ink ribbon is designed such that the leading edge of each transfer-material area 3 is positioned directly under the thermal head 27 at the time when the corresponding cue mark 1 is detected. Therefore, the distance L1 between the leading edge of each transfer-material area 3 and the corresponding cue mark 1 is set to be equal to the distance L2 between the attachment position of the thermal head 27 and the attachment position of the mark detection sensor (61A and 61B).

Therefore, according to the known method, the size of the margin areas 5 that do not contribute to the print operation is increased as the distance L2 is increased, and the total length of the ink ribbon is increased accordingly.

In comparison, the thermal printer according to the present embodiment has a control function for positioning the leading edge of the transfer-material area 11 to be used first in a single printing process at a position directly under the thermal head 27 by rewinding the ink ribbon 23 by a predetermined distance L3 (=L1−L2) after detecting the corresponding cue mark 15.

In addition, in the thermal printer, to position the transfer-material areas used in the second and following cycles in the printing process, the cue mark detection is performed during the print operation for the previous cycle and the feed amount L5 for positioning the next transfer-material area is calculated when the print operation for the previous cycle is finished. Then, the ink ribbon 23 is moved forward by the calculated feed amount.

Therefore, the distance L1 between the leading edge of each transfer-material area 11 and the corresponding cue mark 15 can be minimized.

Accordingly, the size of the areas in the base film that do not contribute to printing (i.e., the margin areas 13) can be minimized and the consumption of the base film can be reduced. As a result, the total length of the ink ribbon can be reduced without reducing the number of sheets that can be printed on, and the winding diameter of the ink ribbon can be reduced accordingly. The reduction in the consumption of the base film contributes not only to a reduction in the manufacturing cost but also to a reduction in the overall size of a ribbon cassette, which leads to a reduction in the size of a housing of the thermal printer.

As the detection accuracy expected in the above-described movement control method and the feed accuracy of the ink ribbon are increased, the size of a margin provided in each transfer-material area can be minimized. Therefore, the transfer-material area can be used efficiently and the environmental load can be reduced.

In the known method, the distance L2 between the attachment position of the thermal head 27 and that of the mark detection sensor is set as small as possible in order to reduce the size of each margin area in the ink ribbon 23. Thus, the attachment positions of the thermal head 27 and the mark detection sensor are limited.

In comparison, when the movement control method according to the present embodiment is used, the limitation to the distance L2 is removed and there is more freedom in the spatial layout of the components.

In addition, among the transfer-material areas used in a single printing process (four transfer-material areas in the present embodiment), the ink ribbon is moved forward in the cueing operation for positioning the transfer-material areas used in the second and following cycles. Therefore, compared to the case in which the operation of detecting the cue mark 15 and rewinding the ink ribbon by the predetermined distance L3 is repeated for all of the transfer-material areas, the time for cueing and the movement amount of the ink ribbon 23 can be reduced.

The feed amount L5 is calculated on the basis of the movement amount St of the ink ribbon 23 that can be most accurately measured (the movement amount during the period between the detection of the cue mark and the end of the print operation). In addition, in principle, the propagation of error does not occur since the count value for determining the movement amount St is reset when the cue mark is detected. Therefore, the cueing accuracy is not reduced.

(a) The structure of the ink ribbon that allows color printing and laminate processing is described in the above-described embodiment.

However, the structure in which the distance L1 between the leading edge of each transfer-material area and the corresponding cue mark (that is, the length L0 of each margin area 13) is set to be smaller than the distance L2 between the attachment position of the thermal head 27 and that of the mark detection sensor may be applied to other kinds of ink ribbons.

For example, the above-described structure may also be applied to ink ribbons for color printing with which laminate processing is not performed. In such a case, transfer-material areas for yellow ink (Y), magenta ink (M), and cyan ink (C) form a group, and the transfer-material areas for the three colors are repeatedly arranged on the base film.

Although three-color printing is described above as an example, the above-described structure may also be applied to color printing using four or more colors including black (K). In addition, the above-described structure may also be applied to ink ribbons for arbitrary multi-color printing depending on the use.

The above-described structure may also be applied to ink ribbons for single-color printing. FIG. 16 shows the structure of an ink ribbon that allows printing using black ink (K) only. As shown in the figure, all of the transfer-material areas correspond to black ink (K).

The color of the ink is, of course, not limited to black (K), and may also be yellow (Y), magenta (M), cyan (C), and other colors. In addition, the above-described structure may also be applied to a ribbon film dedicated to laminate processing.

(b) In the above-described embodiment, all of the cue marks for the transfer-material areas have the same shape.

However, the cue marks may have different shapes depending on the kinds of the corresponding transfer-material areas and the positional relationships therebetween.

For example, in a group of transfer-material areas used for printing on a single sheet, the shape of the cue mark for the first transfer-material area may be different from that of the cue marks for the second and following transfer-material areas.

FIG. 17 shows the structure of an ink ribbon having such an arrangement. According to this arrangement, the phase of the ink ribbon can be recognized. For example, if a black bar extending across the ink ribbon but having a cutout in an intermediate position thereof is detected in the cue-mark detection performed before starting the print operation, the phase displacement can be detected before starting the print operation. In this case, the ink ribbon is moved forward until a bar without a cutout that extends across the ink ribbon is detected.

(c) In the above-described embodiment, each cue mark 15 is positioned at substantially the center of the corresponding margin area 13.

However, the position of each cue mark 15 is not limited as long as it is located within the corresponding margin area 13. For example, each cue mark 15 may be positioned at the leading edge of the corresponding margin area 13, as shown in FIG. 18. Alternatively, each cue mark 15 may also be positioned at the trailing edge of the corresponding margin area 13.

(d) In the above-described embodiment, the leading edge of only the transfer-material area to be used first in a single printing process is positioned by rewinding the ink ribbon after detecting the cue mark.

However, the operation of positioning the leading edge at the print start position by rewinding the ink ribbon may also be performed a plurality of times in a single printing process.

Alternatively, the operation of positioning the leading edge at the print start position by rewinding the ink ribbon may be performed only for the first transfer-material area in successively performed printing processes. In such a case, the print time can be further reduced. Here, the "successively performed printing processes" includes the case in which a "single printing process" is repeatedly performed for printing a print pattern on a plurality of recording sheets.

(e) In the above-described embodiment, transmissive sensors are used as the sensors installed in the thermal printer. However, other sensors, such as reflective sensors, may also be used.

(f) Although the dye-sublimation thermal printer is explained in the above-described embodiment, the structure of the above-described embodiment may also be applied to thermal printers using a melting method or a thermosensitive method.

(g) In the above-described embodiment, the ribbon movement controller 81 is provided as a hardware structure. However, a function similar to that of the ribbon movement controller 81 may also be obtained by causing a microprocessor (arithmetic unit) to perform a corresponding signal process.

(h) In the above-described embodiment, the recording sheet 25 is continuous and is wound in the form of a roll. However, the present invention may also be applied to the case in which a recording sheet is fed manually or a plurality of recording sheets are fed one sheet at a time.

(i) The above-described movement control program may be distributed via a network, or be distributed in the form of a storage medium in which the program is stored. The storage medium may be a magnetic storage medium, an optical storage medium, a semiconductor storage medium, etc.

(j) The above-described embodiment may be variously modified within the gist of the present invention. In addition, there may be various modifications and applications created based on the description of this specification.

What is claimed is:

1. A print apparatus comprising:

a print unit that records print on a recording medium by pressing a thermal head against the recording medium with a ribbon film placed between the thermal head and the recording medium, the ribbon film having a base film on which transfer-material areas and margin areas including cue marks for the respective transfer-material areas are alternately arranged in the longitudinal direction of the base film;

a cue-mark detector positioned downstream of the print unit and configured to detect the cue marks;

a ribbon-moving mechanism that moves the ribbon film having the transfer-material areas and the cue marks being arranged on the ribbon film such that L1<L2 is satisfied, where L1, which is 0 or more, is a distance between the leading edge of each transfer-material area and the corresponding cue mark and L2, which is more than 0, is a distance between a transfer position of the thermal head and a cue-mark detection position of the cue-mark detector, thereby positioning the ribbon film with respect to a print start position.

2. The print apparatus according to claim 1, wherein a rewind amount of the ribbon film is such that the distance by which the ribbon film is moved backward toward the feed real becomes equal to the difference between the distances L1 and L2 calculated as L2−L1.

3. The print apparatus according to claim 2, wherein an amount of rotation of the feed reel corresponds to the rewind amount of the ribbon film.

4. A ribbon movement control device for use in a print apparatus including a print unit that records print on a recording medium by pressing a thermal head against the recording medium with a ribbon film placed between the thermal head and the recording medium, the ribbon film having a base film on which transfer-material areas and margin areas including cue marks for the respective transfer-material areas are alternately arranged in the longitudinal direction of the base film, and a cue-mark detector positioned downstream of the print unit and configured to detect the cue marks, the ribbon movement control device comprising:

a cue-mark-detection monitor that monitors the cue-mark detection performed by the cue-mark detector while the ribbon film is moved forward, the transfer-material areas and the cue marks being arranged on the ribbon film such that L1<L2 is satisfied, where L1, which is 0 or more, is a distance between the leading edge of each transfer-material area and the corresponding cue mark and L2, which is more than 0, is a distance between a transfer position of the thermal head and a cue-mark detection position of the cue-mark detector; and a ribbon rewinder that moves the ribbon film backward toward a feed reel from a position where the cue-mark detection is accomplished by a distance corresponding to the difference between the distances L1 and L2 calculated as L2−L1, thereby positioning the ribbon film with respect to a print start position.

5. A ribbon film comprising:

a base film on which transfer-material areas and margin areas including cue marks for the respective transfer-material areas are alternately arranged in the longitudinal direction of the base film, wherein the transfer-material areas and the cue marks are arranged such that L0<L2 is satisfied, where L0, which is 0 or more, is a distance between the leading edge of each transfer-material area and the leading edge of the corresponding margin area and L2, which is more than 0, is a distance between a transfer position of the thermal head and a cue-mark detection position.

6. A ribbon film comprising:

a base film on which transfer-material areas and margin areas including cue marks for the respective transfer-material areas are alternately arranged in the longitudinal direction of the base film, wherein the transfer-material areas and the cue marks are arranged such that L1<L2 is satisfied, where L1, which is 0 or more, is a distance between the leading edge of each transfer-material area and the corresponding cue mark and L2, which is more than 0, is a distance between a transfer position of the thermal head and a cue-mark detection position.

7. The ribbon film according to one of claims 5 and 6, wherein the ribbon film is used for single-color printing.

8. The ribbon film according to one of claims 5 and 6, wherein the ribbon film is used for multi-color printing.

9. The ribbon film according to one of claims 5 and 6, wherein dye-containing material is applied in the transfer-material areas.

10. The ribbon film according to one of claims 5 and 6, wherein thermo-compressive material is applied in the transfer-material areas.

11. A ribbon movement control method for use in a print apparatus including a print unit that records print on a recording medium by pressing a thermal head against the recording medium with a ribbon film placed between the thermal head and the recording medium, the ribbon film having a base film on which transfer-material areas and margin areas including cue marks for the respective transfer-material areas are alternately arranged in the longitudinal direction of the base film, and a cue-mark detector positioned downstream of the print unit and configured to detect the cue marks, the ribbon movement control method comprising:

monitoring the cue-mark detection performed by the cue-mark detector while the ribbon film is moved forward, the transfer-material areas and the cue marks being arranged on the ribbon film such that L1<L2 is satisfied, where L1, which is 0 or more, is a distance between the leading edge of each transfer-material area and the corresponding cue mark and L2, which is more than 0, is a distance between a transfer position of the thermal head and a cue-mark detection position of the cue-mark detector; and moving the ribbon film backward toward a feed reel from a position where the cue-mark detection is accomplished by a distance corresponding to the difference between the distances L1 and L2 calculated as L2−L1, thereby positioning the ribbon film with respect to a print start position.

12. A program embodied in a computer readable storage medium that is accessible to a print apparatus, the print apparatus including a print unit that records print on a recording medium by pressing a thermal head against the recording medium with a ribbon film placed between the thermal head and the recording medium, the ribbon film having a base film on which transfer-material areas and margin areas including cue marks for the respective transfer-material areas are alternately arranged in the longitudinal direction of the base film, and a cue-mark detector positioned downstream of the print unit and configured to detect the cue marks, the program comprising:

means for monitoring the cue-mark detection performed by the cue-mark detector while the ribbon film is moved forward, the transfer-material areas and the cue marks being arranged on the ribbon film such that L1<L2 is satisfied, where L1, which is 0 or more, is a distance between the leading edge of each transfer-material area and the corresponding cue mark and L2, which is more than 0, is a distance between a transfer position of the thermal head and a cue-mark detection position of the cue-mark detector; and means for controlling movement of the ribbon film backward toward a feed reel from a position where the cue-mark detection is accomplished by a distance corresponding to the difference between the distances L1 and L2 calculated as L2−L1, thereby positioning the ribbon film with respect to a print start position.

13. A print apparatus comprising:

a print unit that records print on a recording medium by pressing a thermal head against the recording medium with a ribbon film placed between the thermal head and the recording medium, the ribbon film having a base film on which transfer-material areas and margin areas including cue marks for the respective transfer-material areas are alternately arranged in the longitudinal direction of the base film;

a cue-mark detector positioned downstream of the print unit and configured to detect the cue marks;

a ribbon-moving mechanism that moves the ribbon film, the transfer-material areas and the cue marks being arranged on the ribbon film such that L1<L2 is satisfied, where L1, which is 0 or more, is a distance between the leading edge of each transfer-material area and the corresponding cue mark and L2, which is more than 0, is a distance between a transfer position of the thermal head and a cue-mark detection position of the cue-mark detector;

a movement amount acquirer that monitors passage of a cue mark through the cue-mark detection position while a print operation using the transfer-material area corresponding to the cue mark is being performed and determines a movement amount by which the ribbon film is moved in a period between the detection of the cue mark and the end of the print operation; and a first ribbon movement controller that subtracts the determined movement amount from the sum of a length of an unprocessed portion of the transfer-material area determined on the basis of the format of the ink ribbon at the time when the cue mark is detected and the length of each margin area and moves the ribbon film forward by a distance corresponding to the result of subtraction, thereby positioning the leading edge of the next transfer-material area at a print start position.

14. The print apparatus according to claim 13, wherein the movement amount acquirer determines the movement amount by which the ribbon film is moved in the period between the detection of the cue mark and the end of the print operation on the basis of an amount of rotation of a reel, the rotation amount corresponding to a winding diameter of the reel.

15. The print apparatus according to claim 13, further comprising a second ribbon movement controller that monitors the cue-mark detection for a transfer-material area used first in a printing process, the cue-mark detection being performed by the cue-mark detector while the ribbon film is moved forward by the ribbon movement controller, and moves the ribbon film backward toward a feed reel from a position where the cue-mark detection is accomplished by a distance corresponding to the difference between the distances L1 and L2 calculated as L2−L1, thereby positioning the ribbon film with respect to a print start position.

16. A ribbon movement control device for use in a print apparatus including a print unit tat records print on a recording medium by pressing a thermal head against the recording medium with a ribbon film placed between the thermal head and the recording medium, the ribbon film having a base film on which transfer-material areas and margin areas including cue marks for the respective transfer-material areas are alternately arranged in the longitudinal direction of the base film, and a cue-mark detector positioned downstream of the print unit and configured to detect the cue marks, the ribbon movement control device comprising:

a cue-mark-detection monitor tat monitors passage of a cue mark trough a cue-mark detection position of the cue-mark detector while a print operation using the transfer-material area corresponding to the cue mark is being performed, the transfer-material areas and the cue marks being arranged on the ribbon film such that L1<L2 is satisfied, where L1, which is 0 or more, is a distance between the leading edge of each transfer-material area and the corresponding cue mark and L2, which is more than 0, is a distance between a transfer position of the thermal head and the cue-mark detection position;

a movement amount acquirer that determines a movement amount by which the ribbon film is moved in a period between the detection of the cue mark and the end of the print operation; and a feed amount calculator that subtracts the determined movement amount from the sum of a length of an unprocessed portion of the transfer-material area determined on the basis of the format of the ink ribbon at the time when the cue mark is detected and the length of each margin area and moves the ribbon film forward by a distance corresponding to the result of subtraction, thereby positioning the leading edge of the next transfer-material area at a print start position.

17. A ribbon movement control method for use in a print apparatus including a print unit that records print on a recording medium by pressing a thermal head against the recording medium with a ribbon film placed between the thermal head and the recording medium, the ribbon film having a base film on which transfer-material areas and margin areas including cue marks for the respective transfer-material areas are alternately arranged in the longitudinal direction of the base film, and a cue-mark detector positioned downstream of the print unit and configured to detect the cue marks, the ribbon movement control method comprising:

monitoring passage of a cue mark via the cue-mark detector while a print operation using the transfer-material area corresponding to the cue mark is being performed, the transfer-material areas and the cue marks being arranged on the ribbon film such that L1<L2 is satisfied, where L1, which is 0 or more, is a distance between the leading edge of each transfer-material area and the corresponding cue mark and L2, which is more than 0, is a distance between a transfer position of the thermal head and the cue-mark detection position;

determining a movement amount by which the ribbon film is moved in a period between the detection of the cue mark and the end of the print operation; and subtracting the determined movement amount from the sum of a length of an unprocessed portion of the transfer-material area determined on the basis of the format of the ink ribbon at the time when the cue mark is detected and the length of each margin area and moving the ribbon film forward by a distance corresponding to the result of subtraction, thereby positioning the leading edge of the next transfer-material area at a print start position.

18. A program embodied in a computer readable storage medium that is accessible to a print apparatus including a print unit that records print on a recording medium by pressing a thermal head against the recording medium with a ribbon film placed between the thermal head and the recording medium, the ribbon film having a base film on which transfer-material areas and margin areas including cue marks for the respective transfer-material areas are alternately arranged in the longitudinal direction of the base film, and a cue-mark detector positioned downstream of the print unit and configured to detect the cue marks, the program comprising:

means for monitoring passage of a cue mark through a cue-mark detection position of the cue-mark detector while a print operation using the transfer-material area corresponding to the cue mark is being performed, the transfer-material areas and the cue marks being arranged on the ribbon film such that L1<L2 is satisfied, where L1 which is 0 or more, is a distance between the leading edge of each transfer-material area and the corresponding cue mark and L2, which is more than 0, is a distance between a transfer position of the thermal head and the cue-mark detection position;

means for determining a movement amount by which the ribbon film is moved in a period between the detection of the cue mark and the end of the print operation; and means for subtracting the determined movement amount from the sum of a length of an unprocessed portion of the transfer-material area determined on the basis of the format of the ink ribbon at the time when the cue mark is detected and the length of each margin area and moving the ribbon film forward by a distance corresponding to the result of subtraction, thereby positioning the leading edge of the next transfer-material area at a print start position.

* * * * *